US011439288B2

(12) United States Patent
Clas et al.

(10) Patent No.: US 11,439,288 B2
(45) Date of Patent: Sep. 13, 2022

(54) CLEANING TOOL FOR AN EXTRACTOR

(71) Applicant: TTI (Macao Commercial Offshore) Limited, Macau (CN)

(72) Inventors: Tyler Clas, Charlotte, NC (US); Douglas M. Rukavina, Concord, NC (US); Donovan Bode, Charlotte, NC (US); Juan Aviles Quintero, Huntersville, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 381 days.

(21) Appl. No.: 16/577,169

(22) Filed: Sep. 20, 2019

(65) Prior Publication Data

US 2020/0093345 A1 Mar. 26, 2020

Related U.S. Application Data

(60) Provisional application No. 62/734,775, filed on Sep. 21, 2018, provisional application No. 62/778,095, filed on Dec. 11, 2018.

(51) Int. Cl.

| | |
|---|---|
| ***A47L 7/00*** | (2006.01) |
| ***A47L 11/40*** | (2006.01) |
| ***A47L 11/30*** | (2006.01) |

(52) U.S. Cl.
CPC ..... *A47L 11/4088* (2013.01); *A47L 11/30* (2013.01)

(58) Field of Classification Search
CPC ..... A47L 11/4088; A47L 11/30
(Continued)

(56) References Cited

U.S. PATENT DOCUMENTS 5,600,866 A 2/1997 Berfield
6,125,498 A 10/2000 Roberts et al.
(Continued)

FOREIGN PATENT DOCUMENTS

DE 202004020572 U1 9/2005
DE 202014102819 U1 8/2014
(Continued)

OTHER PUBLICATIONS

International Search Report and Written Opinion for Application No. PCT/US2019/052103 dated Jan. 3, 2020 (14 pages).
(Continued)

*Primary Examiner* — Joseph J Hail
*Assistant Examiner* — Shantese L McDonald
(74) *Attorney, Agent, or Firm* — Michael Best & Friedrich LLP

(57) ABSTRACT

A cleaning tool for an extraction cleaner includes a tool body including a nozzle portion connected to an elongated handle portion and a nozzle cover removably mounted to the nozzle portion forming a suction nozzle therebetween. The suction nozzle is configured to extract recovered liquid and dirt. The cleaning tool also includes an internal conduit in fluid communication with the suction nozzle configured to transport recovered liquid and dirt extracted by the suction nozzle. The internal conduit extending longitudinally within the handle portion between opposite ends of the handle portion. The cleaning tool further includes a spray nozzle configured to distribute cleaning liquid forward of the nozzle cover and a supply tube configured to carry cleaning liquid to the spray nozzle. The spray nozzle passes through the suction nozzle or the inlet conduit.

23 Claims, 33 Drawing Sheets

(58) Field of Classification Search
USPC ..... 15/321, 320, 331, 334
See application file for complete search history.

(56) References Cited

U.S. PATENT DOCUMENTS

| | | | | |
|---|---|---|---|---|
| 6,189,178 | B1 | 2/2001 | Roberts | |
| 6,347,428 | B1 | 2/2002 | Shimko et al. | |
| 6,453,506 | B1 | 9/2002 | Sumner | |
| 6,550,098 | B2 | 4/2003 | Roberts et al. | |
| 6,647,585 | B1 | 11/2003 | Robinson | |
| 6,658,693 | B1 | 12/2003 | Reed, Jr. | |
| 6,941,614 | B2 | 9/2005 | Montgomery | |
| 6,968,593 | B1 | 11/2005 | Lenkiewicz et al. | |
| 7,048,804 | B2 | 5/2006 | Kisela et al. | |
| 7,159,275 | B2 | 1/2007 | Chang | |
| 7,225,503 | B1 | 6/2007 | Lenkiewicz et al. | |
| 7,337,490 | B2 | 3/2008 | Goff | |
| 7,367,082 | B2 * | 5/2008 | Gordon | A47L 9/0494 15/320 |
| 7,665,181 | B2 | 2/2010 | Gebhard et al. | |
| 7,707,682 | B2 | 5/2010 | Parr | |
| 7,725,985 | B2 | 6/2010 | Krebs | |
| 7,767,030 | B2 | 8/2010 | Addicks et al. | |
| 7,891,047 | B2 | 2/2011 | Milanese | |
| 7,904,990 | B1 | 3/2011 | Miner | |
| 7,958,595 | B2 | 6/2011 | Goff | |
| 8,122,562 | B2 | 2/2012 | Krebs | |
| 8,230,550 | B2 | 7/2012 | Krebs et al. | |
| 8,341,803 | B2 | 1/2013 | Gardner et al. | |
| 8,349,088 | B1 | 1/2013 | Miner | |
| 8,631,538 | B2 | 1/2014 | Huffman | |
| 8,806,703 | B2 | 8/2014 | Bassett | |
| 8,850,654 | B2 | 10/2014 | Nolan et al. | |
| 9,125,540 | B2 | 9/2015 | Tran et al. | |
| 9,186,028 | B2 | 11/2015 | White et al. | |
| 9,200,739 | B2 | 12/2015 | Vrdoljak | |
| 9,295,365 | B2 | 3/2016 | Huffman et al. | |
| 9,427,128 | B2 | 8/2016 | DeJonge et al. | |
| 9,433,335 | B2 | 9/2016 | Nolan et al. | |
| 9,526,394 | B2 | 12/2016 | Conrad | |
| 9,717,389 | B2 | 8/2017 | Johnson et al. | |
| 9,814,365 | B2 | 11/2017 | Conrad | |
| 9,820,627 | B2 | 11/2017 | Caro, Jr. et al. | |
| 9,867,514 | B2 | 1/2018 | VanTongeren | |
| 9,918,606 | B2 | 3/2018 | Tran et al. | |
| 2001/0039684 | A1 * | 11/2001 | Kasper | A47L 11/40 8/147 |
| 2003/0009843 | A1 | 1/2003 | Chang | |
| 2004/0134016 | A1 | 7/2004 | Kisela et al. | |
| 2004/0177469 | A1 | 9/2004 | Sadaune et al. | |
| 2004/0221420 | A1 | 11/2004 | Phillips | |
| 2005/0015916 | A1 | 1/2005 | Orubor | |
| 2005/0160553 | A1 | 7/2005 | Gregory | |
| 2005/0236012 | A1 | 10/2005 | Josefsson et al. | |
| 2006/0225241 | A1 | 10/2006 | Phillips | |
| 2006/0288517 | A1 | 12/2006 | Oh et al. | |
| 2007/0107159 | A1 | 5/2007 | Kawamoto | |
| 2012/0151696 | A1 | 6/2012 | Hamblin et al. | |
| 2012/0204377 | A1 * | 8/2012 | White | A47L 7/0042 15/322 |
| 2013/0019430 | A1 | 1/2013 | Ruiz et al. | |
| 2014/0053364 | A1 | 2/2014 | Vasudeva | |
| 2014/0259478 | A1 | 9/2014 | Conrad | |
| 2014/0259514 | A1 | 9/2014 | Vail et al. | |
| 2015/0230682 | A1 | 8/2015 | Hamblin et al. | |
| 2016/0135656 | A1 | 5/2016 | Grove | |
| 2016/0353957 | A1 | 12/2016 | DeJonge | |
| 2016/0360943 | A1 | 12/2016 | Krebs et al. | |
| 2017/0000305 | A1 | 1/2017 | Gordon et al. | |
| 2018/0078103 | A1 | 3/2018 | VanTongeren | |
| 2018/0110201 | A1 | 4/2018 | Mohyer et al. | |
| 2018/0116476 | A1 | 5/2018 | Bloemendaal et al. | |
| 2019/0104906 | A1 * | 4/2019 | Royale | A47L 11/30 |

FOREIGN PATENT DOCUMENTS

| | | | |
|---|---|---|---|
| EP | 1407705 | A2 | 4/2004 |
| EP | 1508292 | A2 | 2/2005 |
| EP | 2623007 | A2 | 8/2013 |
| EP | 2656765 | A2 | 10/2013 |
| EP | 2721988 | A2 | 4/2014 |
| EP | 2783615 | A2 | 10/2014 |
| EP | 3066971 | A1 | 9/2016 |
| WO | 9912463 | A1 | 3/1999 |
| WO | 2007132142 | A1 | 11/2007 |
| WO | 2011077273 | A1 | 6/2011 |
| WO | 2017122831 | A1 | 7/2017 |
| WO | 2018055335 | A1 | 3/2018 |

OTHER PUBLICATIONS

Chinese Patent Office Action for Application No. 201980044103.9 dated Jun. 30, 2021 (11 pages including statement of relevance).
Chinese Patent Office Action for Application No. 201980044103.9 dated Mar. 9, 2022 (9 pages including statement of relevance).

* cited by examiner

CLEANING TOOL FOR AN EXTRACTOR

CROSS-REFERENCE TO RELATED APPLICATIONS

This application claims priority to U.S. Provisional Patent Application No. 62/734,775, filed Sep. 21, 2018 and to U.S. Provisional Patent Application No. 62/778,095, filed Dec. 11, 2018, the entire contents all of which are hereby incorporated by reference herein.

BACKGROUND

The present disclosure relates to a cleaning tool for an extraction cleaner.

An extraction cleaner, such as an upright extractor or a canister extractor, typically dispenses cleaning fluid from a supply tank through a distribution nozzle and onto a surface, for example carpet, upholstery, or a hard floor, to clean the surface. It may also be possible to deliver water from the supply tank to the surface through the distribution nozzle to rinse the surface before and/or after the cleaning fluid is applied. The extraction cleaner then draws the cleaning fluid along with dirt from the surface through a suction nozzle and into a recovery tank, leaving the surface relatively clean and dry. Some extractors may be supplied with an accessory tool that includes a suction nozzle to facilitate cleaning of different surfaces.

SUMMARY

In some embodiments, a cleaning tool includes a tool body having a nozzle portion connected to an elongated handle portion, a nozzle cover removably mounted to the nozzle portion, and a suction nozzle configured to extract recovered liquid and dirt, the suction nozzle formed between the nozzle portion and the nozzle cover. The cleaning tool also includes an internal conduit configured to transport recovered liquid and dirt extracted by the suction nozzle, the internal conduit extending longitudinally within the handle portion between opposite ends of the handle portion and having an inlet in fluid communication with the suction nozzle and an outlet configured to connect to an external hose. The cleaning tool further includes a spray nozzle configured to distribute cleaning liquid forward of the nozzle cover, the spray nozzle mounted to the nozzle portion, and a valve mechanism configured to control a flow of cleaning liquid to the spray nozzle, the valve mechanism mounted to the handle portion peripherally of the internal conduit and in fluid communication with the spray nozzle. The cleaning tool additionally includes a supply tube configured to carry cleaning liquid to the valve mechanism, the supply tube connected in fluid communication with the valve mechanism and extending at least partially within the internal conduit.

In some embodiments, a cleaning tool for an extraction cleaner includes a tool body including a nozzle portion connected to an elongated handle portion and a nozzle cover removably mounted to the nozzle portion forming a suction nozzle therebetween. The suction nozzle is configured to extract recovered liquid and dirt. The cleaning tool also includes an internal conduit in fluid communication with the suction nozzle configured to transport recovered liquid and dirt extracted by the suction nozzle. The internal conduit extending longitudinally within the handle portion between opposite ends of the handle portion. The cleaning tool further includes a spray nozzle configured to distribute cleaning liquid forward of the nozzle cover and a supply tube configured to carry cleaning liquid to the spray nozzle. The spray nozzle passes through the suction nozzle or the inlet conduit.

Other features and advantages of the present disclosure will become apparent by consideration of the following description and the appended claims when taken in connection with the accompanying drawings.

BRIEF DESCRIPTION OF THE DRAWINGS

FIG. 3 is a right side elevational view of the cleaning tool of FIG. 1.

DETAILED DESCRIPTION

Figure 1:
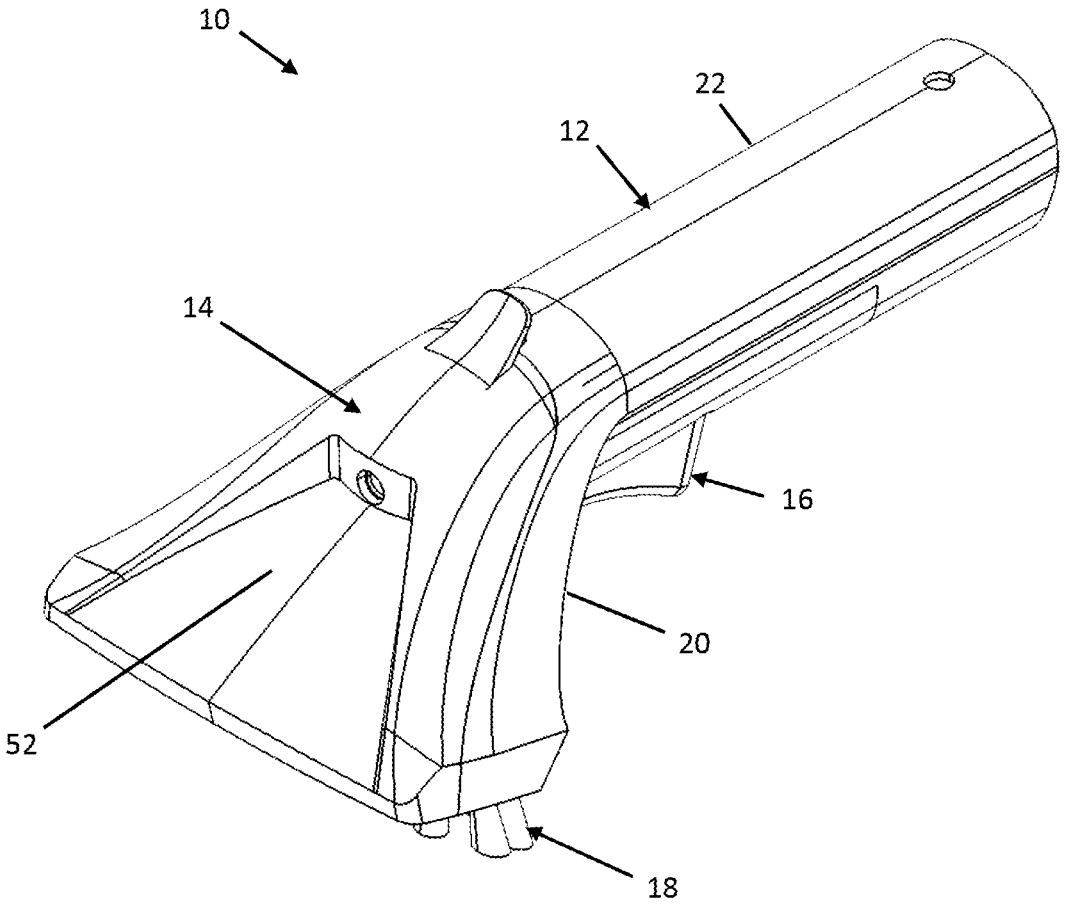
FIG. 1 is a perspective view of a cleaning tool in accordance with an embodiment of the present disclosure.
Figure 2:
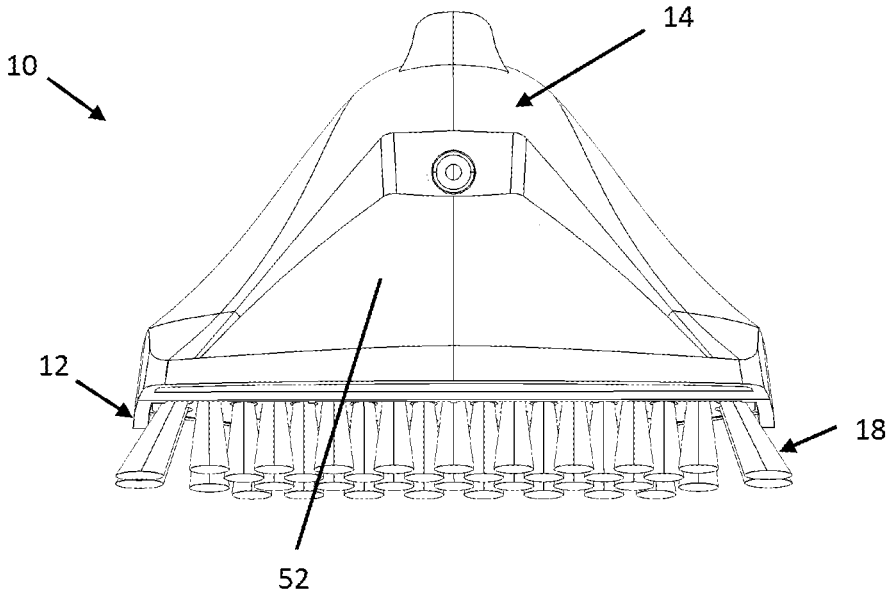
FIG. 2 is a front side elevational view of the cleaning tool of FIG. 1.
Figure 3:
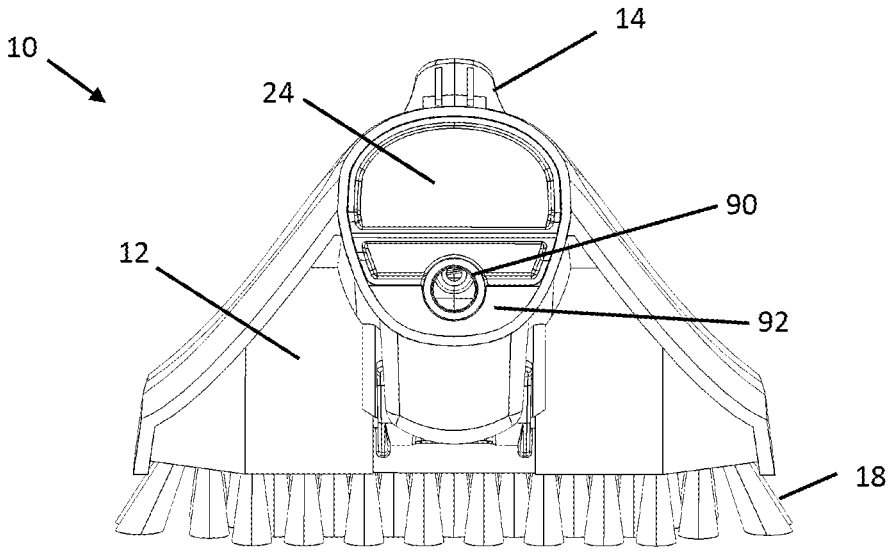
FIG. 3 is a rear side elevational view of the cleaning tool of FIG. 1.

Before any embodiments are explained in detail, it is to be understood that the present disclosure is not limited in its application to the details of construction and the arrangement of components set forth in the following description or illustrated in the following drawings. The present disclosure is capable of other embodiments and of being practiced or of being carried out in various ways. It should be understood that the description of specific embodiments is not intended to limit the disclosure from covering all modifications, equivalents and alternatives falling within the spirit and scope of the disclosure as defined in the appended claims. Also, it is to be understood that the phraseology and terminology used herein is for the purpose of description and should not be regarded as limiting.

Referring now to the figures, FIGS. 1-8 illustrate an embodiment of a cleaning tool 10 that is configured to dispense cleaning liquid from an extraction cleaner onto a surface to be cleaned and to recover liquid and dirt that is drawn up from the surface by the extraction cleaner. As used herein, the term "cleaning liquid" refers to water, a detergent, a sanitizer, or a mixture of water and detergent/sanitizer. The cleaning tool 10 includes a tool body 12, a removable nozzle cover 14, a distribution assembly 16, and an interchangeable cleaning head 18.

With reference to FIGS. 1-8 and 10-11, the tool body 12 includes a nozzle portion 20 defining a suction nozzle 54 and a handle portion 22 that extends rearwardly from the nozzle portion 20. The tool body 12 may be formed from molded plastic as a unitary body or from separate components fixedly attached together. The handle portion 22 has an elongated shape defining an internal conduit 24 that extends longitudinally through the handle portion 22. The internal conduit 24 has an inlet 24*a* at a front end 22*a* of the handle portion 22 and an outlet 24*b* at a rear end 22*b* of the handle portion 22 opposite the front end 22*a*. The cleaning tool 10 includes a spray nozzle 64 configured to distribute cleaning liquid forward of the nozzle portion 20. In the illustrated embodiment, the spray nozzle 64 is mounted to the nozzle portion. The cleaning tool 10 includes a valve mechanism 66 configured to control a flow of cleaning liquid to the spray nozzle 64. A supply tube 88 is configured to carry cleaning liquid to the valve mechanism 66, the supply tube 88 being connected in fluid communication with the valve mechanism 66 and extending at least partially within the internal conduit 24. In the illustrated embodiment, the spray nozzle 64 passes through the suction nozzle 54 to a frontal position to distribute cleaning fluid forward of the nozzle portion 20.

Figure 9:
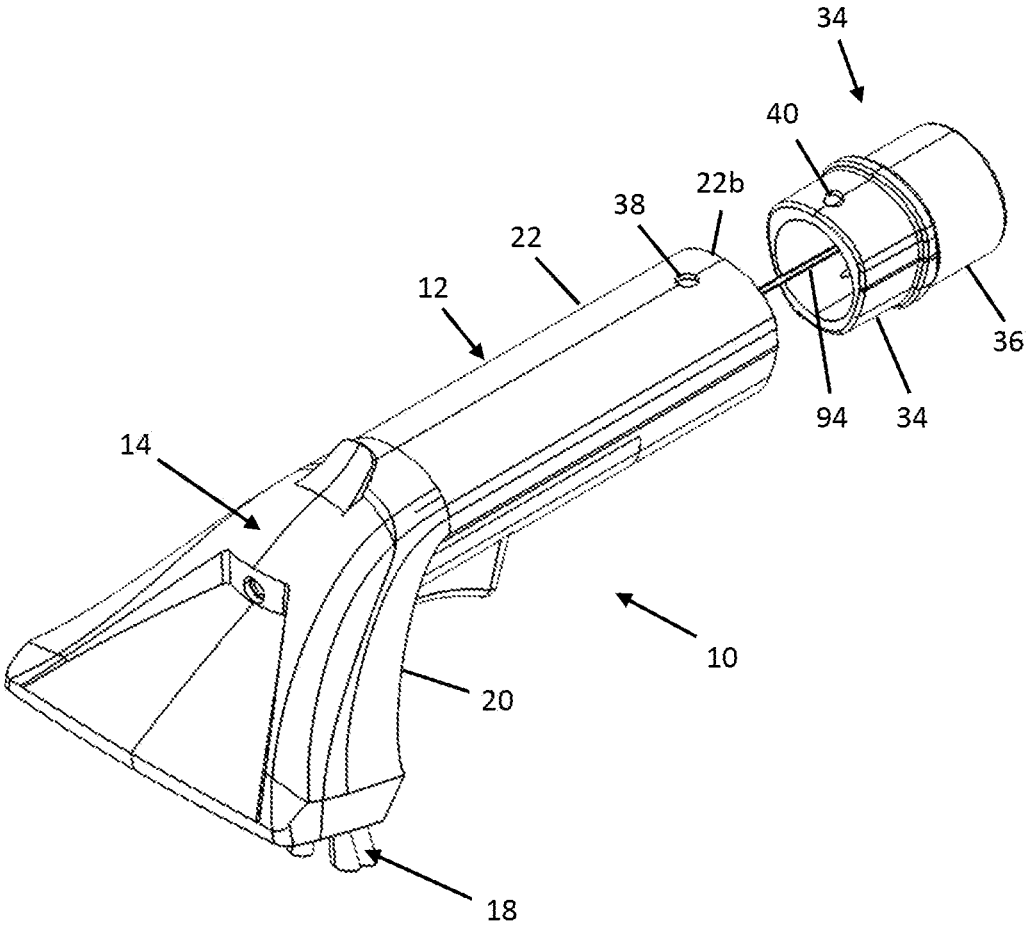
FIG. 9 is a partially exploded perspective view of the cleaning tool of FIG. 1 in combination with a hose fitting.

As illustrated in FIG. 9, the rear end 22*b* of the handle portion 22 is configured to connect to a hose fitting 34 formed integrally with or attached to an external hose 36. In the illustrated embodiment, the rear end 22*b* of the handle portion 22 is generally shaped to match the shape of the free end of the hose fitting 34 and is sized to receive the free end of the hose fitting 34 therein. As a result, the internal conduit 24 of the handle portion 22 is in fluid communication with the inside of the hose for transporting recovered liquid and dirt to the extraction cleaner. In some embodiments, the cleaning tool may be detachably coupled to the hose fitting 34. For example, one or more retaining holes 38 may be formed in the top wall 26 and/or the bottom wall 28 of the handle portion 22 proximate its rear end 22*b* to receive one or more retaining nubs 40 that is depressably mounted on the hose fitting 34. Alternatively, other suitable hose connections may be used.

The handle portion 22 includes a top wall 26 along the length of the handle portion 22. The handle portion 22 also includes a bottom wall 28 connected to the top wall 26 forming the shape of the handle portion. The bottom wall 28 includes a forward section 30 proximate the front end 22*a* of the handle portion 22 and a rear section 32 proximate the rear end 22*b* of the handle portion 22. In the illustrated embodiment, the forward section 30 includes a recess that transitions to the rear section 32 between the front end 22*a* and the rear end 22*b* at a step transition area 92. In some embodiments, for example, the forward section 30 of the bottom wall 28 may have a generally planar and flat shape forming a recess and the rear section 32 of the bottom wall 28 may have a curved cross-sectional profile perpendicular to its length such that the recessed forward section 30 transitions to the curved rear section 32 at the step transition area 92.

Figure 10:
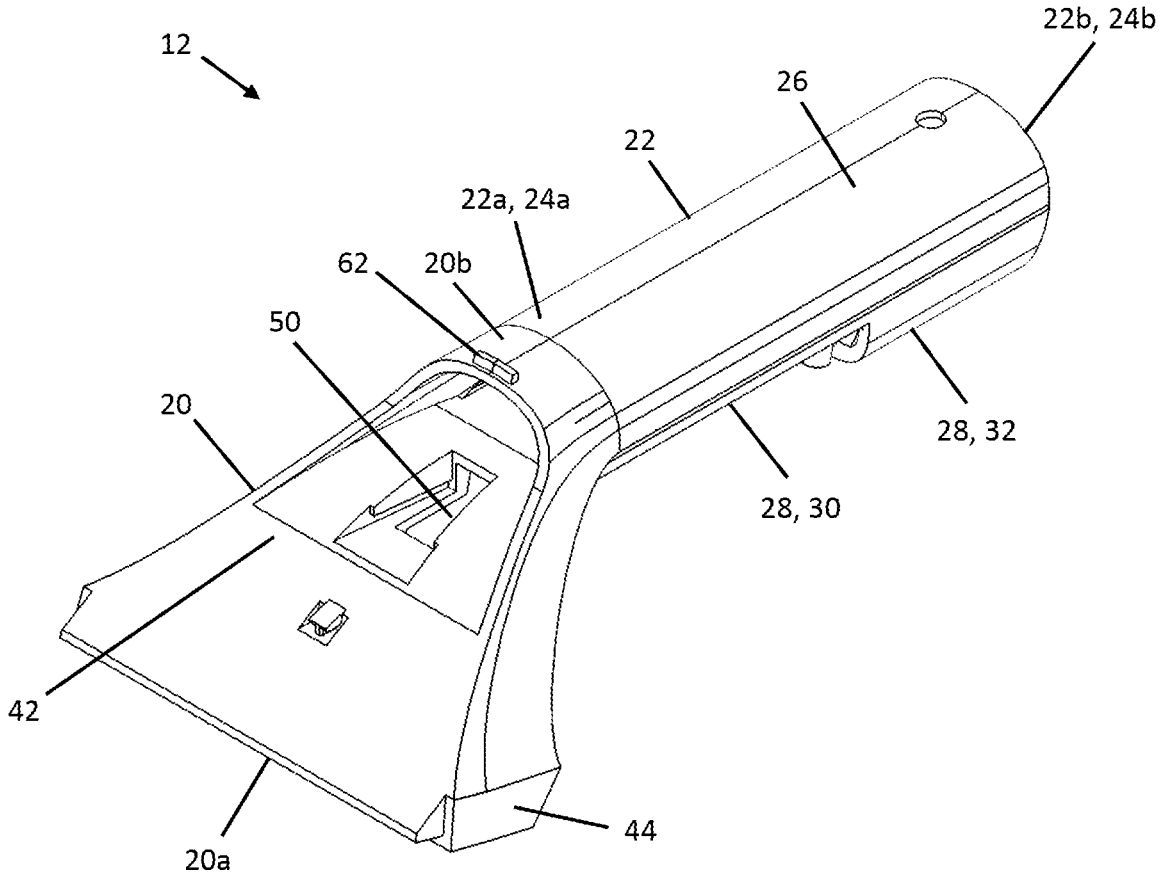
FIG. 10 is a perspective view of the tool body of the cleaning tool of FIG. 1.
Figure 11:
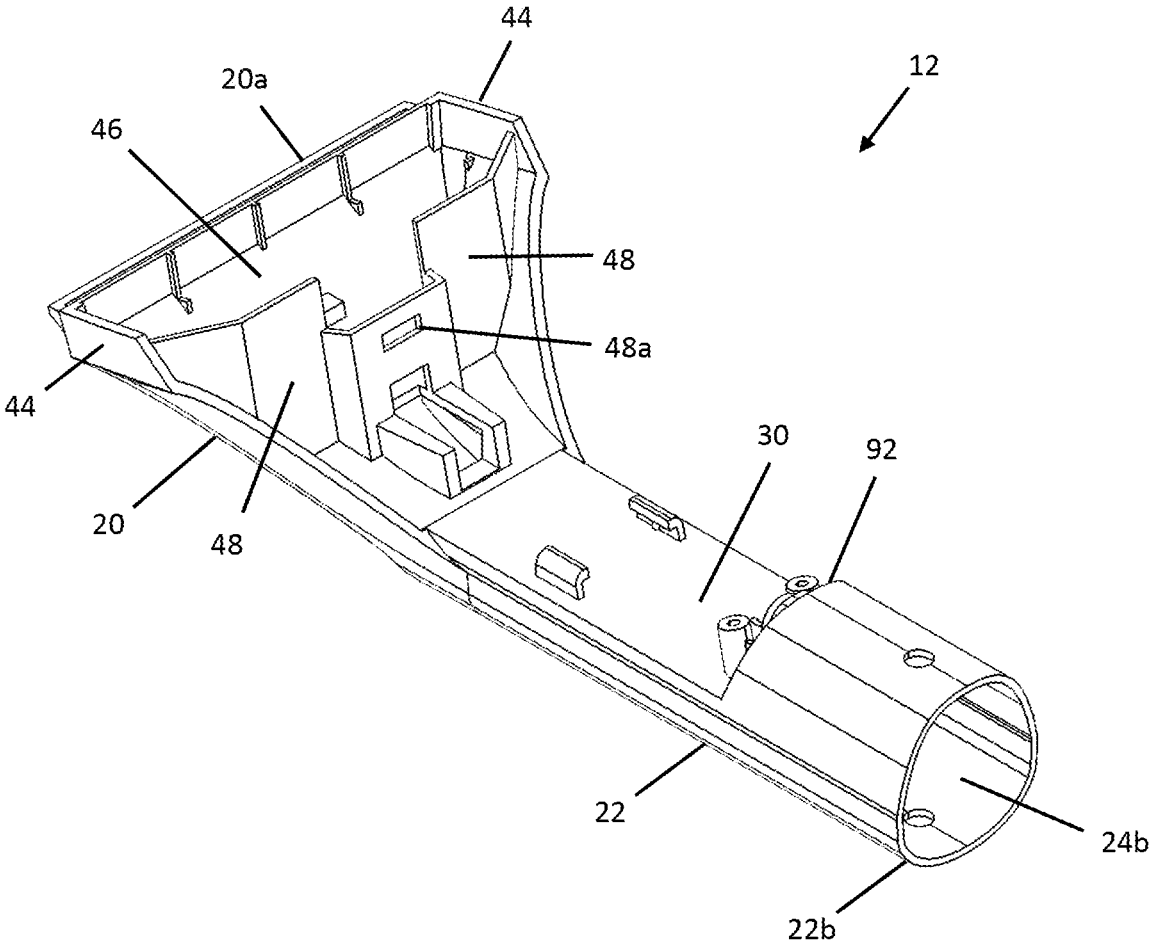
FIG. 11 is another perspective view of the tool body of the cleaning tool of FIG. 1.

Referring to FIGS. 10-11, the nozzle portion 20 of the tool body 12 includes a frontal wall 42 sloping and/or curving downwardly from a rear end 20*b* to a leading or forward end 20*a* of the nozzle portion 20 relative to the longitudinal axis of the handle portion 22. A pair of side walls 44 are formed integrally with the frontal wall 42 on opposite sides of the frontal wall 42 and extend below and may extend partially above the frontal wall 42. The frontal wall 42 and the side walls 44 form a receiving area 46 for the interchangeable cleaning head 18 at an underside of the leading end 20*a* of the nozzle portion 20 below the frontal wall 42, as described further below. A rear wall 48 may be provided between the side walls 44 proximate the leading end 20*a* of the nozzle portion 20 facing oppositely to the frontal wall 42. The rear wall 48 may be provided to bound a portion of the receiving area 46 if desired. For example, the rear wall 48 may extend upwardly generally perpendicular relative to a plane of the receiving area 46 and may intersect with the frontal wall 42. At the rear end 20*b* of the nozzle portion 20, the frontal wall 42 merges with the handle portion 22 adjacent a forward end of the internal conduit 24. In the illustrated embodiment, the frontal wall 42 includes a nozzle receiving aperture 50 configured to receive a spray nozzle 64 of the distribution assembly 16, as described further below. In the illustrated embodiment, the nozzle receiving aperture 50 is located on the frontal wall 42 symmetrically between the side walls 44 proximate the rear end 20*b* of the nozzle portion 20.

With reference to FIGS. 12-16, the nozzle cover 14 is removably coupled to the nozzle portion 20 over the frontal wall 42 to form an enclosed suction nozzle 54 therebetween. In the illustrated embodiment, the nozzle cover 14 has shell-like shape with a concave interior face. A recessed area 52 is formed on the external face of the nozzle cover 14 and is open to the spray nozzle 64 of the distribution assembly 16, as described further below. The side edges of the nozzle cover 14 produced by its shell-like shape follow and conform to the contours of the forward-facing edges of the side walls 44 of the nozzle portion 20 when the nozzle cover 14 is coupled to the nozzle portion 20. As a result, the nozzle cover 14 may be generally flush with or overlap the side walls 44 of the nozzle portion 20 and with the top wall 26 of the handle portion 22 to provide a generally smooth appearance, as illustrated in FIGS. 1-5, whereby the suction nozzle 54 is at least partially bounded by the nozzle cover 14 and the nozzle portion 20. In some embodiments, the nozzle cover 14 may be made from molded plastic, and may be a clear or translucent plastic so the user can see the recovered liquid and dirt being drawn into the suction nozzle 54.

In the embodiment of FIGS. 6 and 12-16, the leading or forward end 14*a* of the nozzle cover 14 has one or more inwardly extending portions 56 at its front edge to retain the nozzle cover 14 on the front portion 20. In other embodiments, the nozzle cover may be retained on the front portion 20 by engagement with the side walls 44. In the illustrated embodiment, the inwardly extending portion 56 extends along the width of the forward end 14*a* with a slot 58 formed in the inwardly extending portion 56 longitudinally along a length of the inwardly extending portion 56. When the nozzle cover 14 is coupled to the nozzle portion 20, the slot 58 forms an inlet 54*a* of the suction nozzle 54 for extracting recovered liquid and dirt from the surface to be cleaned. Alternatively, a gap provided between the forward end 14*a* of the nozzle cover 14 and the leading end 20*a* of the nozzle portion 20 may form the inlet 54*a* of the suction nozzle 54. In the illustrated embodiment, the inwardly extending portion 56 of the nozzle cover 14 rests flush and co-planar with the bottom edges of the side walls 44 of the nozzle portion 20. The rear end 14*b* of the nozzle cover 14 and the rear end 20*b* of the nozzle portion 20 cooperate with each other to form a suction nozzle outlet 54*b* adjacent to and in fluid communication with the conduit inlet 24*a* at the front end 22*a* of the handle portion 22. The illustrated suction nozzle outlet 54*b* has an outlet axis that is parallel to the longitudinal axis of the handle portion 22.

Figure 9A:
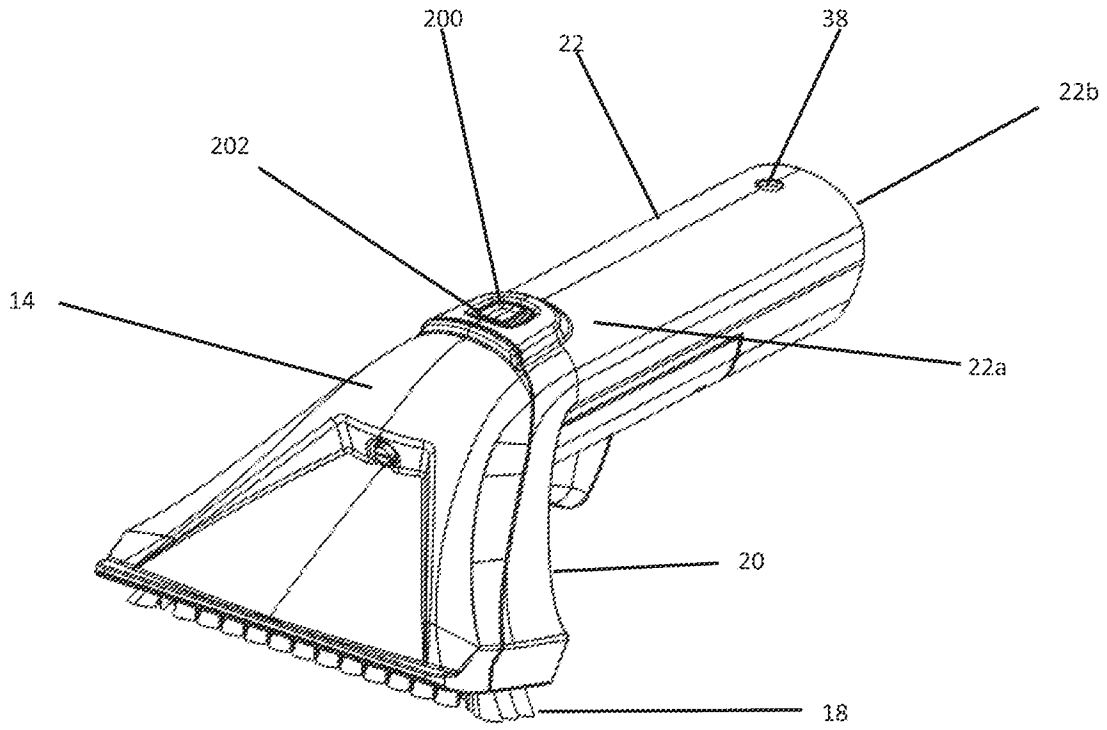
FIG. 9*a* is a partially exploded perspective view of an alternative embodiment of the cleaning tool of FIG. 1.
Figure 12:
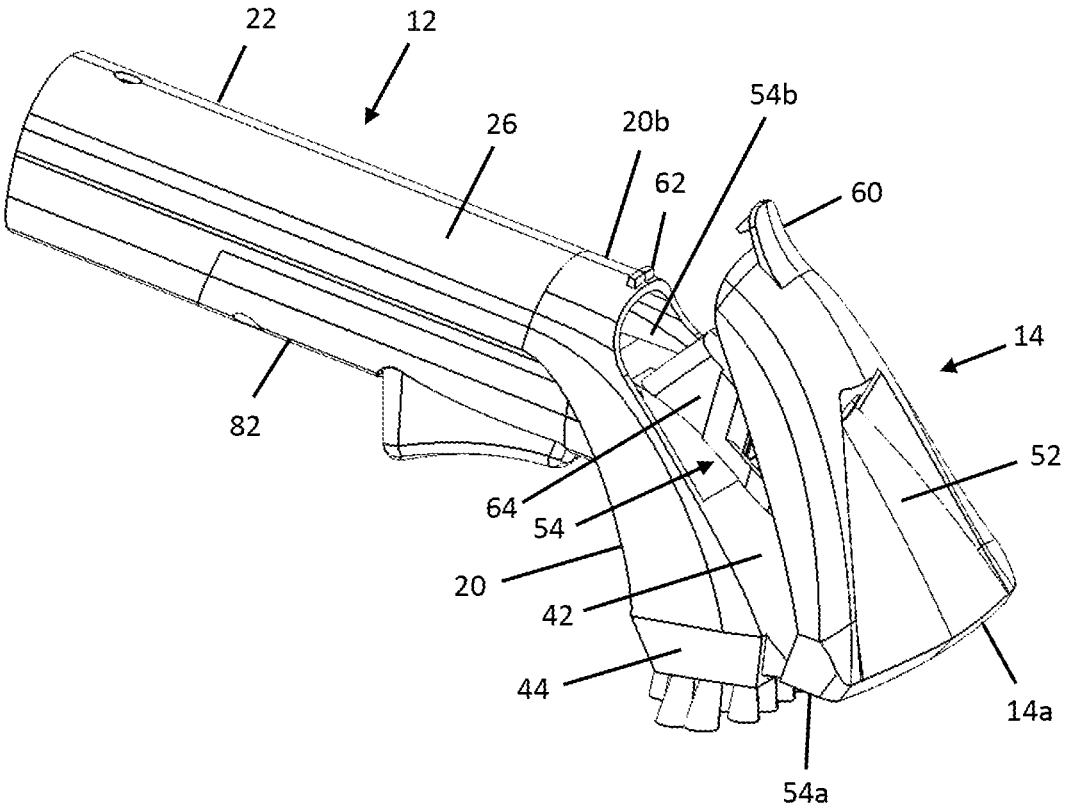
FIG. 12 is a perspective view of the cleaning tool of FIG. 1 with the nozzle cover partially removed.
Figure 12A:
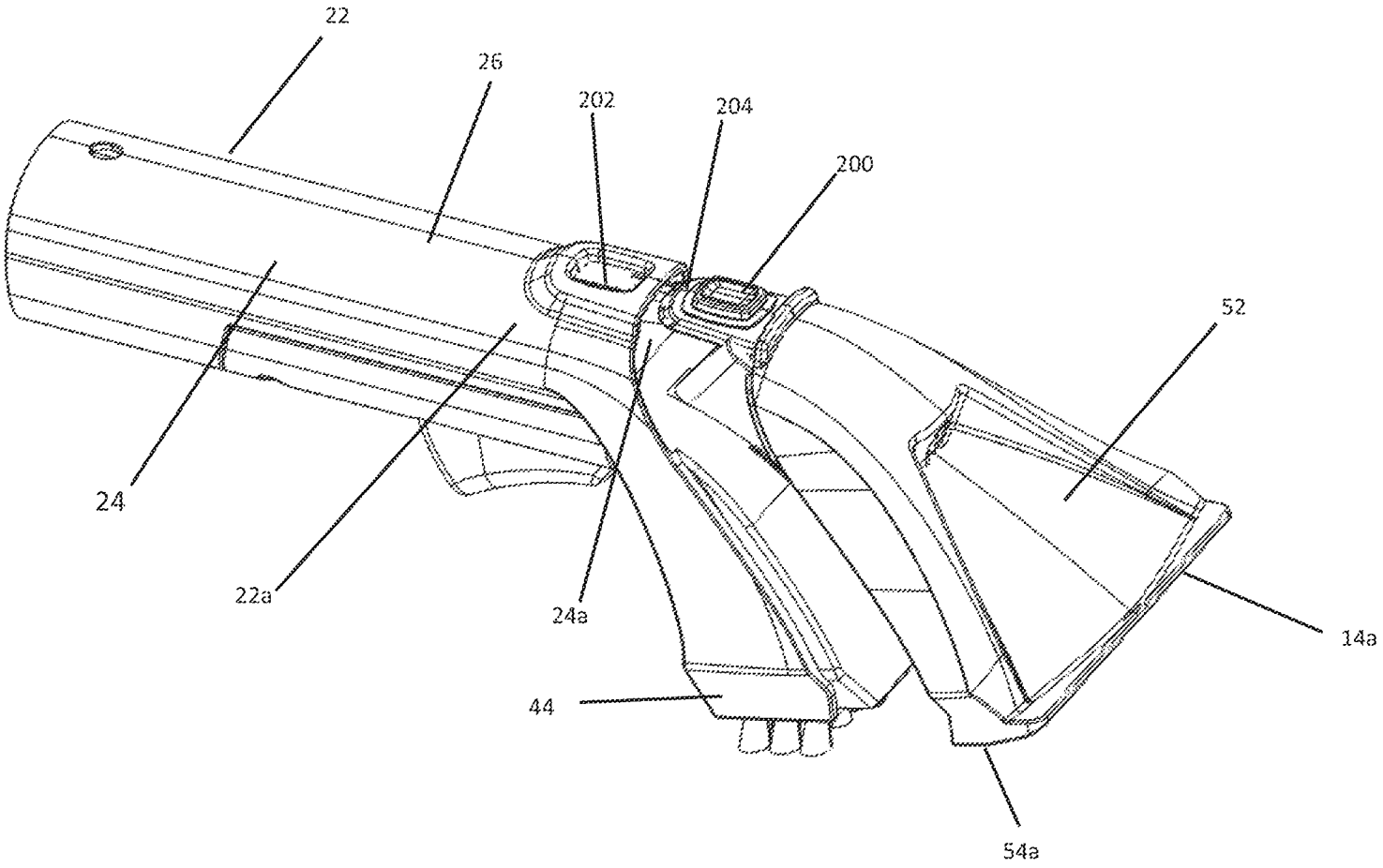
FIG. 12*a* is a perspective view of the cleaning tool of FIG. 9*a* with the nozzle cover partially removed.

The nozzle cover 14 may be removably attached to the nozzle portion 20 by way of a catch or clip mechanism, or the like. In the embodiment shown in FIGS. 5, 9, 12, and 13, the nozzle cover 14 includes a catch member 60 integrally formed at its rear and configured to engage resiliently a recess or a projection formed on the tool body 12, such as, for example, a raised tab 62 formed on the top wall 26 of the handle portion 22 or on the nozzle portion 20 proximate the front end 22*a* of the handle portion 22. For the illustrated catch, to remove the nozzle cover 14, a user pulls upward on the catch member 60 to disengage the catch member 60 from the raised tab 62 and then pivots the nozzle cover 14 forwardly away from the nozzle portion 20. In an alternative embodiment, shown in FIGS. 9*a*, 12*a*, and 13*a*, the nozzle cover 14 includes a depressible button 200 configured to engage a detent 202 on the handle portion 22 or on the nozzle portion 20 proximate the front end 22*a* of the handle portion 22. As shown in FIG. 12*a*, the detent 202 is formed by an aperture through a wall of the internal conduit 24. In one embodiment, the nozzle cover 14 includes the depressible button 200 on a resilient member 204, and the depressible button 200 is configured to releasably engage the detent 202 through the internal conduit inlet 24*a* at the front end 22*a* of the handle portion 22. When engaged with the aperture forming the detent 202, the depressible button 200 inhibits air ingress through the aperture in the internal conduit 24. In one embodiment, the depressible button 200 includes a resilient seal engagable with and closing the aperture. For the illustrated depressible button 200 and detent 202, to remove the nozzle cover 14, a user pushes the depressible button 200 below the detent 202, and pulls the nozzle cover 14 forwardly and away from the nozzle portion 20. The nozzle cover 14 may be removed for cleaning or maintenance of the suction nozzle 54 and may be interchangeable with another nozzle cover, for example, to facilitate cleaning different types of surfaces. In some embodiments, the nozzle cover 14 may include a squeegee blade, for example along the inlet 54*a*, for facilitating removal of cleaning liquid from a hard floor or other flat surface to be cleaned.

Figure 13:
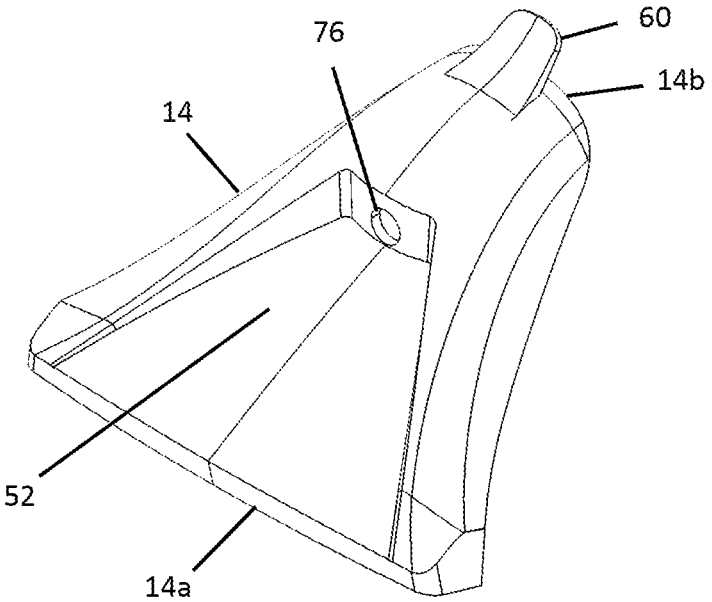
FIG. 13 is a perspective view of the nozzle cover of the cleaning tool of FIG. 1.
Figure 14:
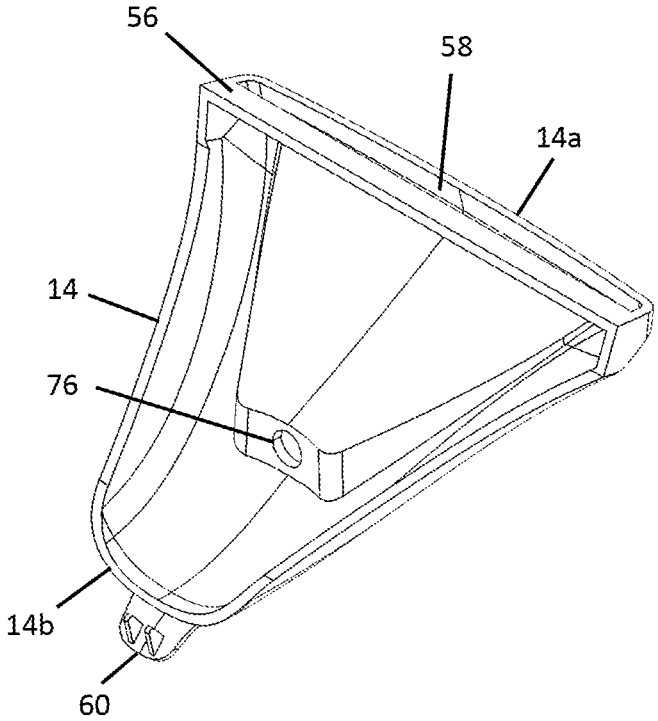
FIG. 14 is another perspective view of the nozzle cover of the cleaning tool of FIG. 1.
Figure 13A:
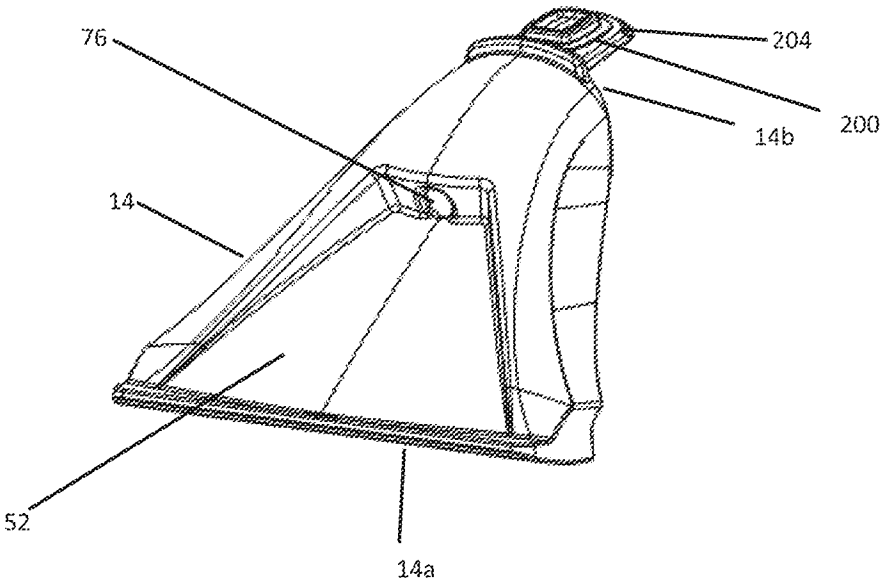
FIG. 13*a* is a perspective view of the nozzle cover of the cleaning tool of FIG. 9*a*.
Figure 15:
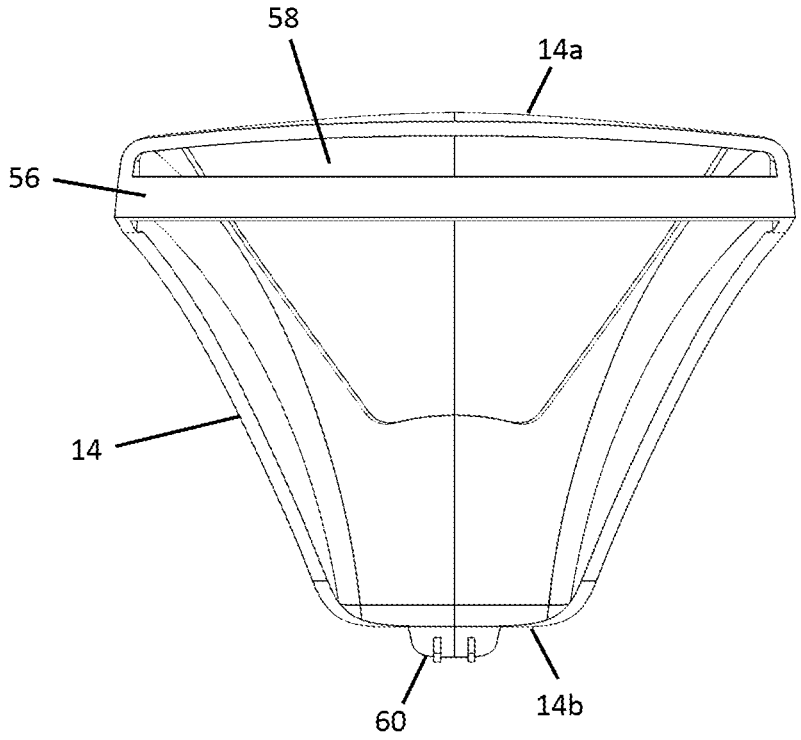
FIG. 15 is a bottom plan view of the nozzle cover of the cleaning tool of FIG. 1.
Figure 16:
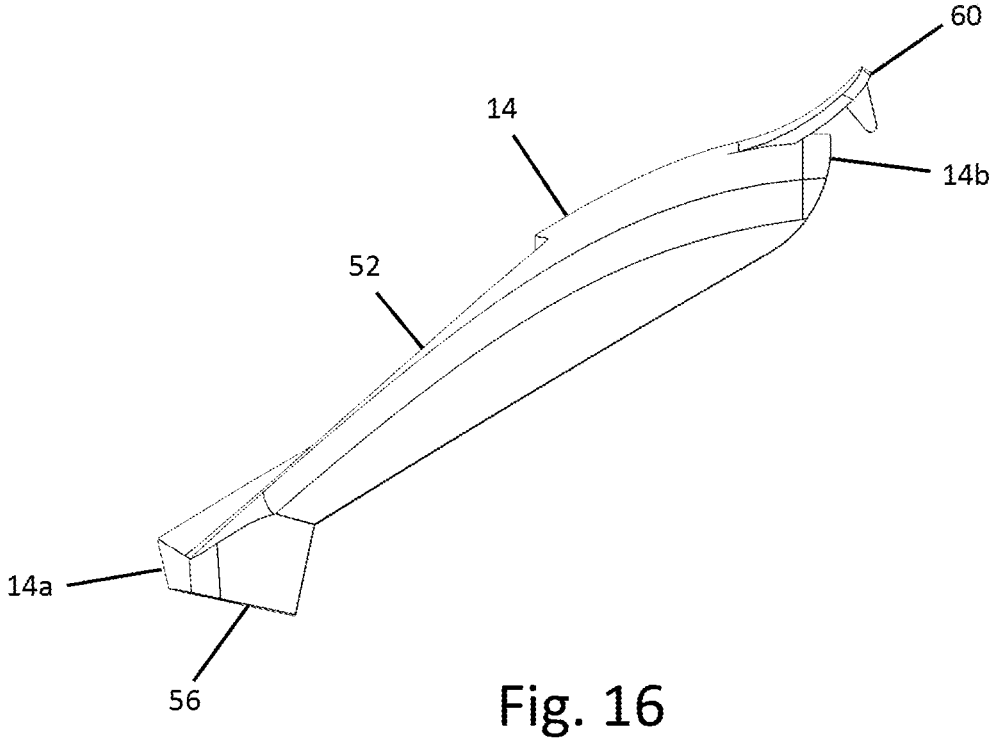
FIG. 16 is a right side elevational view of the nozzle cover of the cleaning tool of FIG. 1.

With reference to FIGS. 7-8 and 17-20, the distribution assembly 16 includes the spray nozzle 64 and the valve mechanism 66. The spray nozzle 64 is mounted to the frontal wall 42 of the nozzle portion 20 for distributing cleaning liquid onto a surface to be cleaned. In the illustrated embodiment, the spray nozzle 64 includes a nozzle tip 68 connected to a spray conduit 69 and a nozzle housing 70 configured to support the nozzle tip 68 and spray conduit 69 at least partially therein. The nozzle housing 70 is connected with the nozzle receiving aperture 50 of the frontal wall 42 and is attached to the frontal wall 42 by way of a catch or clip mechanism, or the like. In one embodiment, one end of the nozzle tip 68 is received in a pass-through opening 72 formed in a front face of the nozzle housing 70. The spray conduit 69 end opposite the nozzle tip 68 is positioned in the nozzle receiving aperture 50 and is fluidly coupled to the valve mechanism 66 by a nozzle tube 74. When the nozzle cover 14 is coupled to the nozzle portion 20, the spray nozzle 64 passes through the suction nozzle 54 to a frontal position configured to distribute cleaning fluid forward of the nozzle portion 20 through an access opening 76. More specifically, the spray nozzle 64 is at least partially covered by the nozzle cover 14 and is located in the flow path of the suction nozzle 54 between the suction nozzle inlet 54*a* and the suction nozzle outlet 54*b*, as illustrated, for example, in FIG. 12. The recessed area 52 on the outer surface of the nozzle cover 14 has a rear face that defines the access opening 76 aligned coaxially with the pass-through opening 72 to allow cleaning liquid to be distributed from the nozzle tip 68 through the access opening 76 onto the surface to be cleaned, as illustrated in FIG. 13. In one embodiment, the nozzle tip 68 is retained in the opening 76 in the nozzle cover 14 such that installation of the nozzle cover 14 to the nozzle portion 20 fluidly connects the nozzle tip 68 with a forward end of the spray conduit 69.

Referring to FIGS. 7-8 and 17-19, the valve mechanism 66 includes a normally closed valve 78 to control the flow of cleaning liquid from the extraction cleaner to the spray nozzle 64 and a user-actuatable trigger 80 to control the opening and closing of the valve 78. The trigger 80 is described herein as a trigger or lever configured to actuate the valve 78. However, the trigger 80 may be a switch, linear actuator, rotary actuator or any other electrical or mechanical interface suitable for actuating the valve 78. The valve 78 and the trigger 80 are mounted on an external surface of the recessed forward section 30 of the bottom wall 28 of the handle portion 22, and thus are located on the exterior of the internal conduit 24. Also, a tool body cover 82 is attached to the bottom wall 28 over the forward section 30 so as to cover at least a portion of the valve mechanism 66. The tool body cover 82 may be configured to cooperate with the rear section 32 of the bottom wall 28 and the top wall 26 so as to provide a generally smooth appearance for the handle portion 22. A trigger opening 84 is formed in the tool body cover 82 to receive the trigger 80 therethrough. The tool body 12 cover may be removably attached to the bottom wall 28 using fasteners (e.g., screws, bolts, etc.), tabs, hooks, or the like to allow access to the valve mechanism 66.

In the illustrated embodiment, the valve 78 is a spring biased valve having a generally cylindrical valve body 86 with a side inlet port 86*a* and side outlet port 86*b*. The valve body 86 may be secured on the forward section 30 of the bottom wall 28 by retaining brackets or hooks and integrally formed with the bottom wall 28. The side inlet port 86*a* and side outlet port 86*b* may be oriented in generally opposite directions radially away from the longitudinal axis of the valve body 86 to facilitate installation into the narrow space along the forward section 30. The valve 78 also includes a spring biased plunger 87 configured to translate axially within the valve body 86 between a closed position and an open position in which the plunger 87, respectively, to prevent and permit fluid communication between the side inlet port 86*a* and the side outlet port 86*b*.

Figure 19:
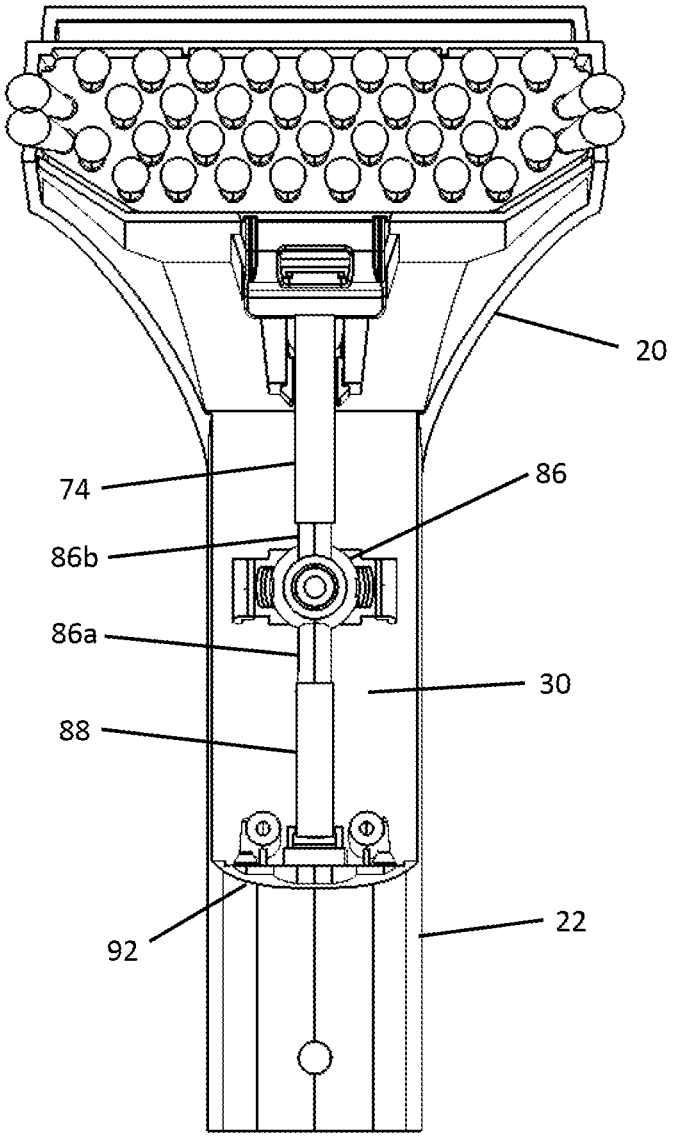
FIG. 19 is a bottom plan view of the cleaning tool of FIG. 1 with the nozzle cover, the tool body cover and the trigger removed.
Figure 20:
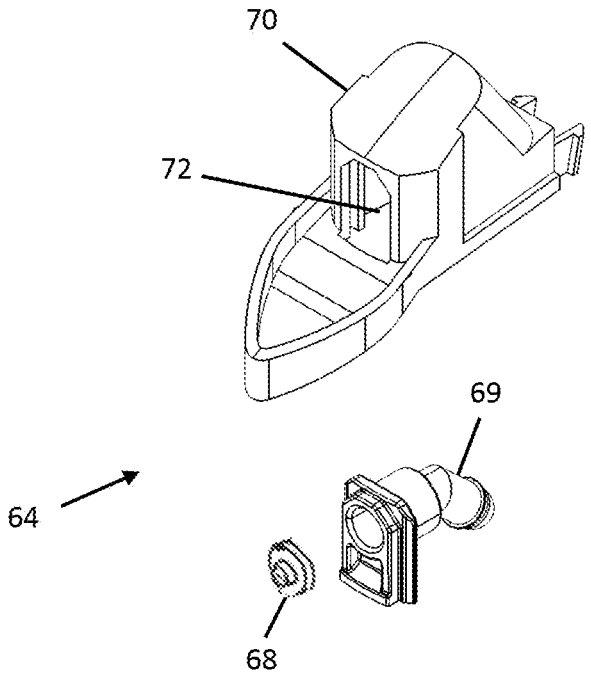
FIG. 20 is an exploded perspective view of the spray nozzle of the cleaning tool of FIG. 1.
Figure 21:
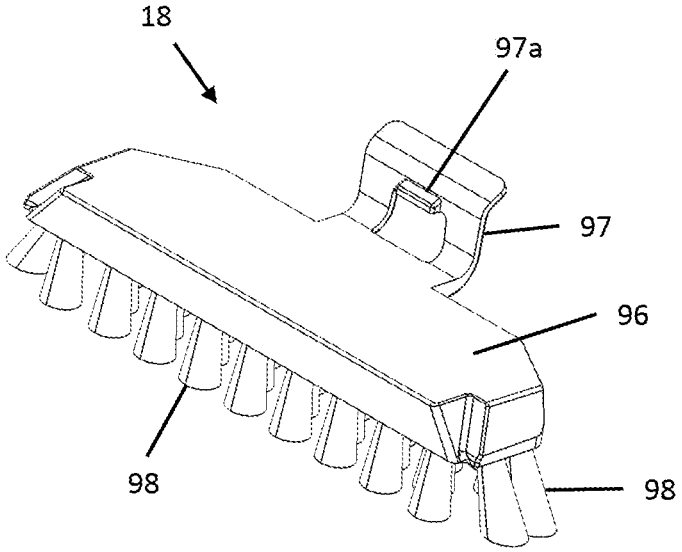
FIG. 21 is a perspective view of the cleaning head of the cleaning tool of FIG. 1.

As illustrated in FIG. 19, the side outlet port 86*b* is connected in fluid communication to the nozzle tube 74, which is connected in fluid communication to the spray nozzle 64 to deliver cleaning liquid to a surface to be cleaned. The nozzle tube 74 extends under the conduit inlet 24*a* of the handle portion 22 and along the forward section 30 of the bottom wall 28 of the handle portion 22. The side inlet port 86*a* is connected in fluid communication to a proximal end of a supply tube 88 to receive cleaning liquid under pressure from the extraction cleaner. The supply tube 88 extends rearwardly to the conduit outlet 24*b* at the rear end 22*b* of the handle portion 22. In particular, the supply tube 88 passes through an opening 90 (shown in FIG. 3) formed in the step transition area 92 of the bottom wall 28. The distal end of the supply tube 88 is fluidly coupled to a delivery tube 94 (shown in FIG. 9) that is carried within the external hose 36 for delivering cleaning liquid under pressure from the extraction cleaner to the cleaning tool 10. For example, the supply tubing 94 carried within the external hose 36 may be fluidly connected to a pump of the extraction cleaner to deliver cleaning liquid from a supply tank of the extraction cleaner, as described further below. In some embodiments, the supply tube 88 and the supply tubing 94 may be integrally formed.

Figure 8:
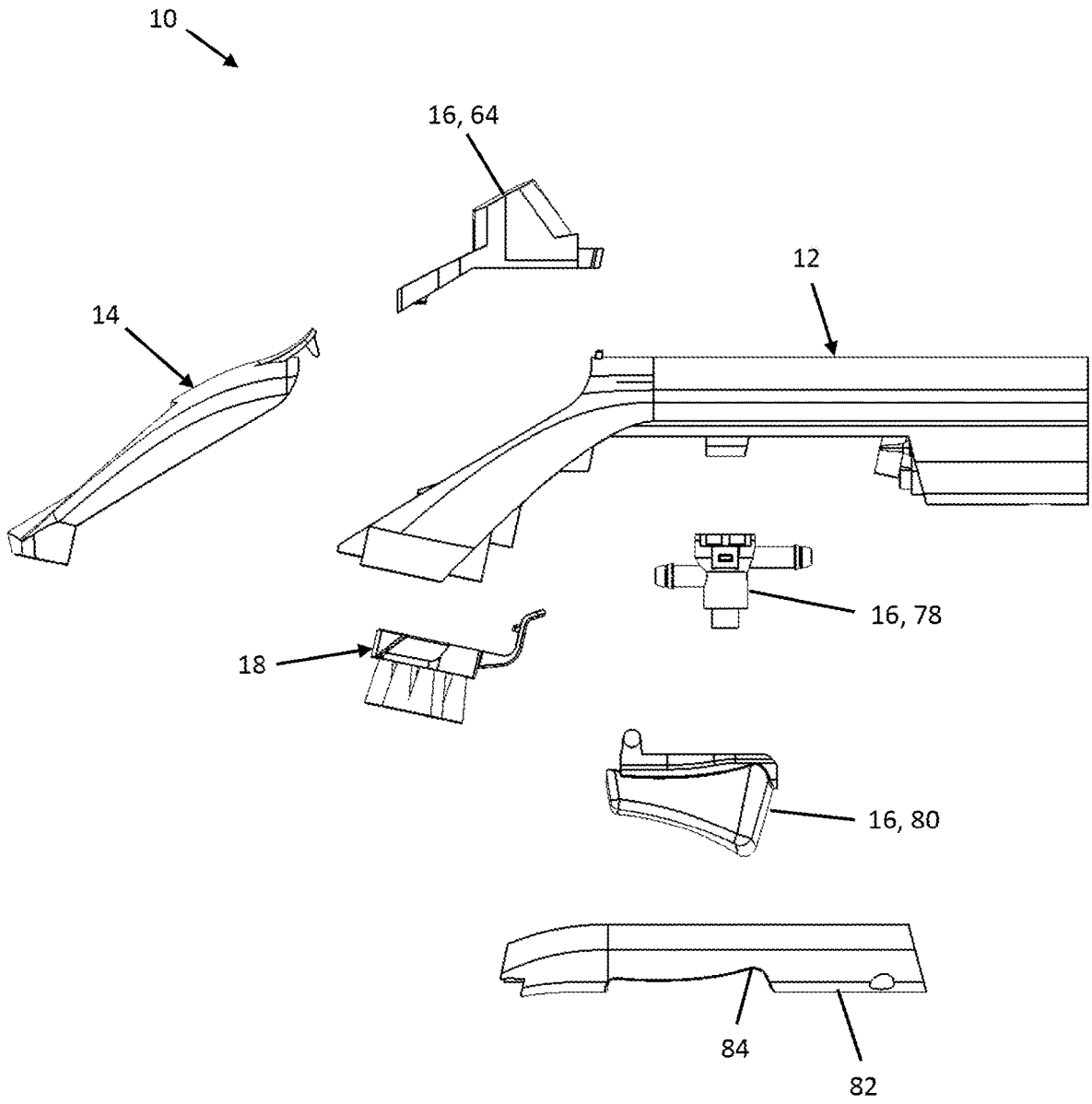
FIG. 8 is a partially exploded right side view of the cleaning tool of FIG. 1 with the nozzle tube and the supply tube removed.
Figure 17:
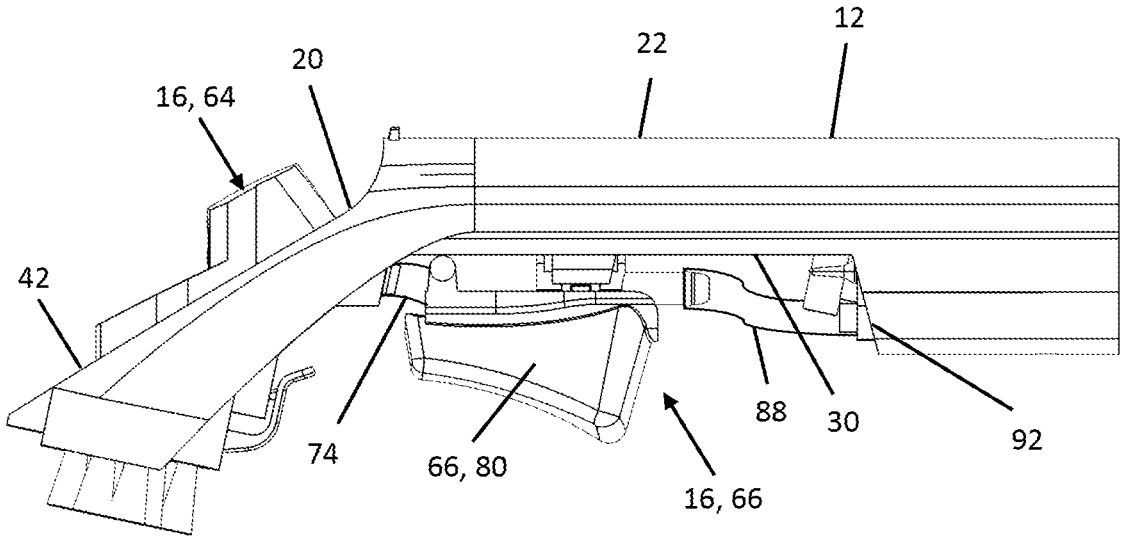
FIG. 17 is a right side elevational view of the cleaning tool of FIG. 1 with the nozzle cover and the tool body cover removed.
Figure 18:
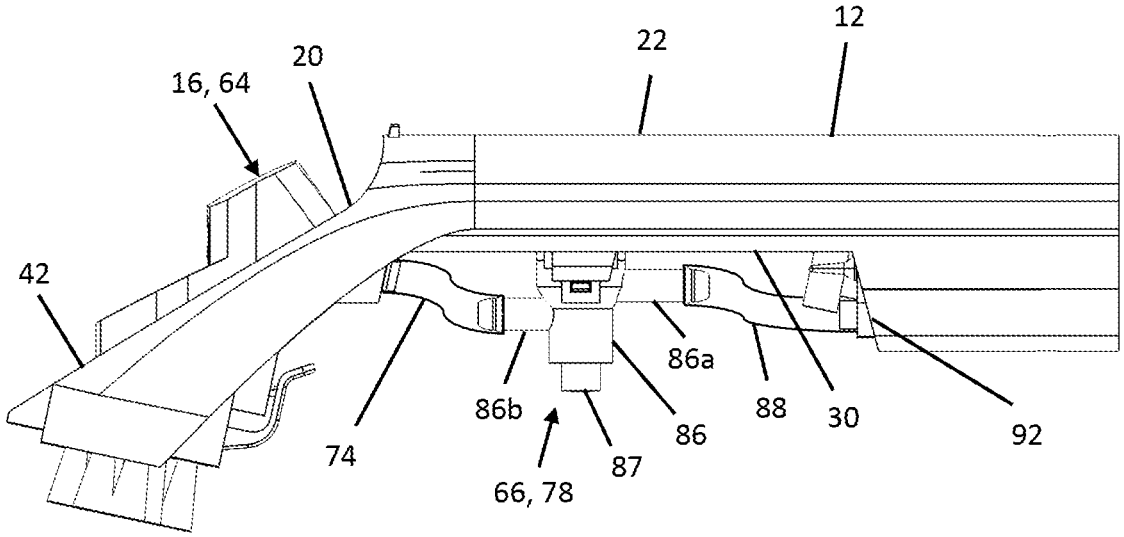
FIG. 18 is a right side elevational view of the cleaning tool of FIG. 1 with the nozzle cover, the tool body cover and the trigger removed.

Referring to FIGS. 8 and 17, the illustrated trigger 80 has a hollow body and is positioned over the valve body 86 of the valve 78. The trigger 80 is arranged with its longitudinal axis generally parallel to the flat forward section 30 of the bottom wall 28 and is pivotally mounted at one end to the flat forward section 30. When the trigger 80 is depressed in operation, an interior surface of the trigger 80 pivots into engagement with the end of the plunger 87, which extends out from the valve body 86 in the closed position, to cause the plunger 87 to move to its open position. Once the valve 78 is opened, cleaning liquid can be delivered from the extraction cleaner through the supply tubing 94 and the supply tube 88 to the valve 78 and on through the nozzle tube 74 to the spray nozzle 64. When the trigger 80 is released, the plunger 87 returns to its closed position under the force of the valve 78 so as to close the valve 78 and shut-off the flow of cleaning liquid to the spray nozzle 64.

With reference to FIGS. 1-8 and 21, the cleaning head 18 is removable and is interchangeable with another cleaning head, for example, to clean different types of surfaces or perform different floor cleaning operations or to be replaced when worn. The cleaning head 18 may include a base member 96 and one or more cleaning members 98, such as brushes, bristles, knobs or squeegee blades, extending from a face of the base member 96. The base member 96 is shaped and sized to be received in the receiving area 46 formed at the leading end 20*a* of the nozzle portion 20 below the frontal wall 42. In some embodiments, the base member 96 may be retained in position, for example, with a tight fit or a snap fit. In other embodiments, the base member 96 may be detachably coupled to the nozzle portion 20 by way of a catch or clip mechanism, or the like.

In the illustrated embodiment, the base member 96 of the cleaning head 18 has a generally rectangular shape configured to be matingly received in the receiving area 46 with the cleaning members 98 facing downwardly toward the surface to be cleaned. The base member 96 includes a resilient catch 97 for removably coupling the cleaning head 18 to the rear wall 48 of the nozzle portion 20. The catch 97 extends from a surface on the base member 96 in a direction opposite the cleaning members 98 and is biased to engage resiliently with the rear wall 48 or other attachment point of the nozzle portion 20 when the base member 96 is installed in the receiving area 46. More specifically, a projection 97*a* formed on the catch 97 may be urged into engagement in a hole 48*a* (shown in FIG. 11) formed in the rear wall 48 by the spring force of the resilient catch 97. To remove the illustrated cleaning head 18, a user pushes downwardly on the end of the catch 97 to deform and disengage the catch 97 from the rear wall 48 and pulls the cleaning head 18 away from the nozzle portion 20.

Figure 22:
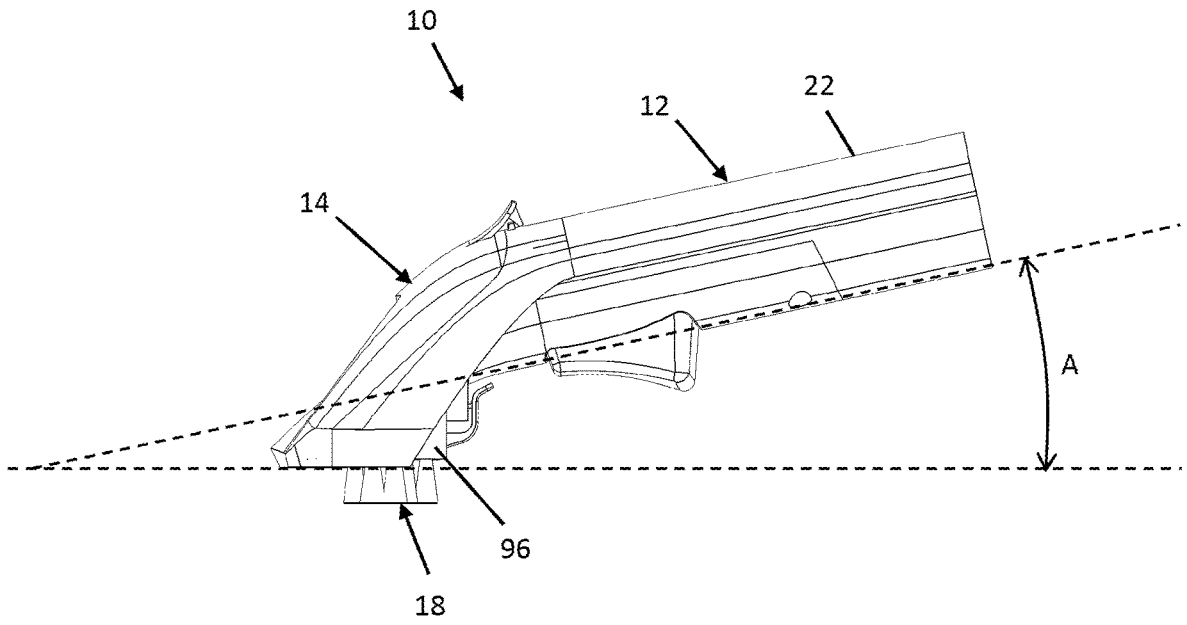
FIG. 22 is another right side elevational view of the cleaning tool of FIG. 1.
Figure 23:
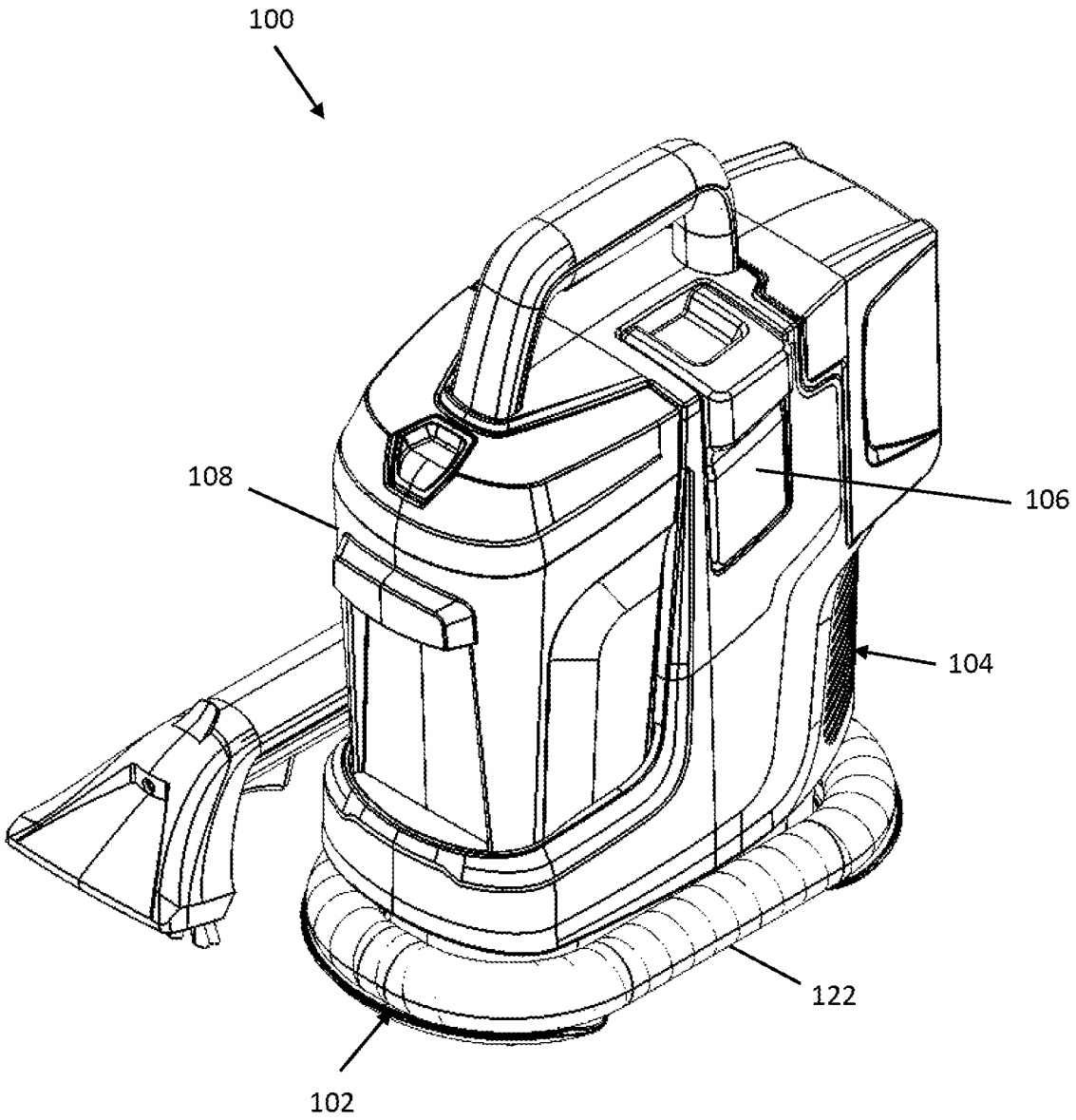
FIG. 23 is a perspective view of a portable extraction cleaner including a cleaning tool in accordance with an embodiment of the present disclosure.
Figure 24:
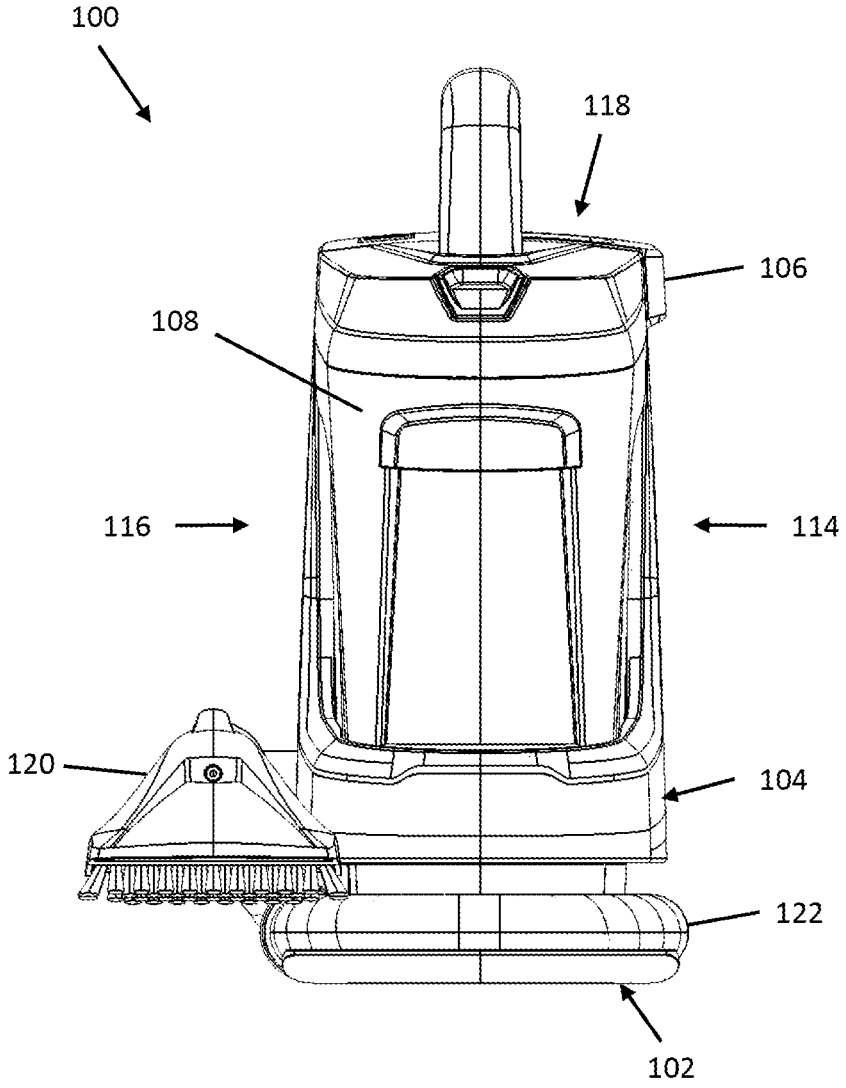
FIG. 24 is a front side elevational view of the portable extraction cleaner of FIG. 1.
Figure 25:
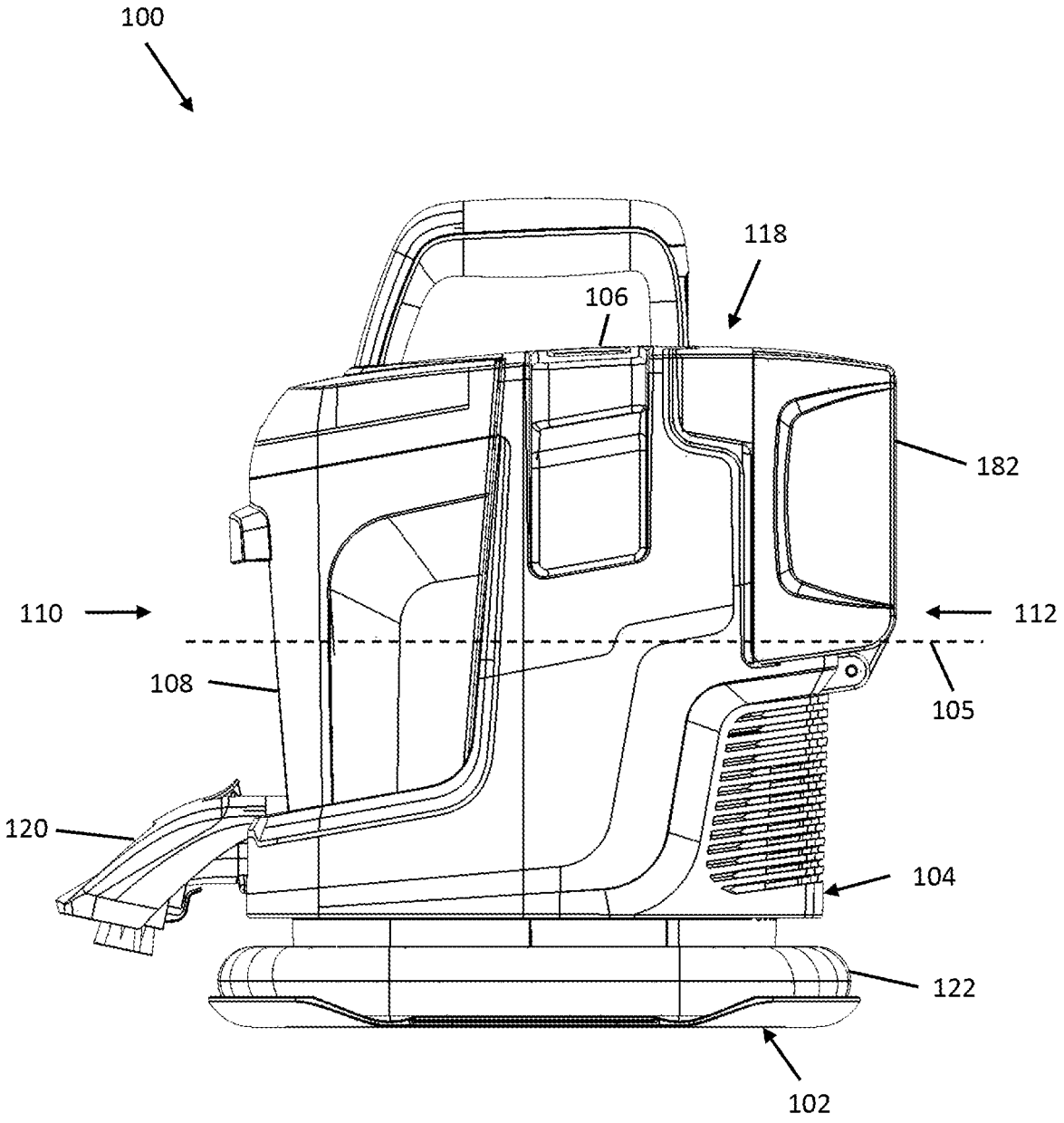
FIG. 25 is a right side elevational view of the portable extraction cleaner of FIG. 1.

Referring to FIG. 22, when the cleaning head 18 is installed in the receiving area 46, the base member 96 lies in a plane that is at an acute angle A with respect to a direction parallel to the longitudinal axis of the handle portion 22. In one embodiment, the angle A is in a range of 5 to 20 degrees. In the illustrated embodiment, the angle A is about 12 degrees. During use of the cleaning tool 10, the user may typically position the cleaning tool 10 so that the cleaning head 18 lies flat on the surface to be cleaned. As a result, the handle portion 22 is inclined upwardly relative to the surface to be cleaned to provide a clearance to operate a trigger 80 of the distribution assembly 16, as described further below, when holding the handle portion 22 during use. In other embodiments, the angle A can be any suitable acute angle to facilitate using the tool to a clean a particular surface. In yet other embodiments, the plane of the base member 96 can be parallel to the longitudinal axis of the handle portion 22.

In another embodiment illustrated in FIGS. 23-29, a cleaning tool 120 according to the present disclosure may be used with a portable extraction cleaner or extractor 100. Components of the cleaning tool 120 are similar to those of the cleaning tool 10 described above and a duplicate description is omitted here. As used below with regard to the illustrated extraction cleaner 100, the term "horizontal" or "horizontally" is not limited to a direction or plane that is substantially or approximately parallel to a floor or other support surface on which the portable extractor is sitting, but also refers more generally to an orientation that is more lying over than upright. Similarly, the term "vertical" or "vertically" is not limited to a direction or plane that is substantially or approximately perpendicular to a floor or other support surface on which the portable extractor is sitting, but also refers more generally to an orientation that is more upright than lying over. The terms "top," "bottom," "upper" and "lower" refer to relative positions in a vertical direction. The terms "front" and "rear" refer to relative positions in a horizontal direction along a longitudinal axis of the portable extractor.

The portable extractor 100 has a front side 110, a rear side 112 opposite the front side 110 defining a horizontal longitudinal axis 105 from the front side 110 to the rear side 112, two opposite lateral sides 114 and 116 disposed between the front side 110 and the rear side 112, and a top side 118. The portable extractor 100 is a canister type extractor that is configured to be easily carried and operated by a user to clean a surface. The portable extractor 100 may be adapted to clean a variety of surfaces, such as carpets, upholstery, hardwood floors, tiles, or the like. The illustrated portable extractor 100 distributes or sprays a cleaning liquid onto a surface to be cleaned and then draws the recovered liquid and dirt from the surface via the cleaning tool 120.

The portable extractor 100 includes a base 102 and a main housing 104 mounted on top of the base 102. A supply tank 106 for holding a cleaning liquid to be dispensed onto a surface being cleaned and a recovery tank 108 for receiving and storing recovered liquid and dirt drawn up from the surface being cleaned are removably supported by the main housing 104. The recovery tank 108 is arranged at the front side 110 of the portable extractor 100. In the illustrated embodiment, the recovery tank 108 has portions at least partially defining the front side 110 and the top side 118 of the portable extractor 100. More specifically, the recovery tank 108 includes a tank lid 212 at least partially defining the top side 118 of the portable extractor. In addition, the supply tank 106 is arranged rearwardly of the recovery tank 108 at the first lateral side 114 of the portable extractor 100. In the illustrated embodiment, the supply tank 106 has portions at least partially defining at least one of the top side 118 and the first lateral side 114. The portable extractor 100 further includes a battery pack 180 spaced rearwardly of the supply tank 106 and supported by the main housing 104 at the rear side 112 of the extractor opposite the front side 110.

In one embodiment, the main housing 104 is configured to removably support the recovery tank 108 in an upward orientation in which the tank lid 212 at least partially defines the top side 118 of the portable extractor 100. A tank latch 220 is provided in a top portion of the tank lid 212 configured to selectively secure and release the tank lid 212 to the main housing 104 when the recovery tank 108 is supported by the main housing 104.

A cleaning tool 120 is fluidly coupled to the recovery tank 108 via a flexible hose 122 for transporting recovered liquid and dirt drawn up from the surface by the cleaning tool 120 to the recovery tank 108. The cleaning tool 120 is also in fluid communication with the supply tank 106, for example, via a conduit carried in the flexible hose 122, for dispensing cleaning liquid onto the surface to be cleaned. The cleaning tool 120 may be detachably coupled to the main housing 104 at the second lateral side 116 of the portable extractor 100 opposite the first lateral side 114.

With reference to FIGS. 30-33, the base 102 may include a lower base portion 124 coupled to an upper base portion 126. The lower base portion 124 and the upper base portion 126 may be separate components releasably or permanently attached together using fasteners (e.g., screws, bolts, etc.), tabs or hooks. Alternatively, the upper base portion 126 may be integrally formed with the lower base portion 124, or the upper base portion 126 and the lower base portion 124 may be formed together as a unitary body. The lower base portion 124 has a flat bottom surface to support the portable extractor 100 on a floor or other generally flat support surface. The lower base portion 124 includes one or more peripheral flanges or projections 128 formed at least partially along the perimeter of the lower base portion 124 proximate the bottom end of the base 102. The peripheral flanges 128 extend upwardly and outwardly beyond the perimeter of the upper base portion 126 to support one or more portions of the flexible hose 122 when the flexible hose 122 is wrapped around the base 102 for storage. The peripheral flanges 128 may define one or more access recesses 129 between them to facilitate gripping and handling of the flexible hose 122.

In the illustrated embodiment, a pair of peripheral flanges 128 are provided respectively at the oppositely facing front and rear ends of the lower base portion 124. The illustrated peripheral flanges 128 form a pair of access recesses 129 between them, which are located on opposite sides of the lower base portion 124. Preferably, the sides of the access recesses 129 are beveled to inhibit catching or snagging the flexible hose 122 upon removal from its stored position. In some embodiments, such as shown in FIG. 8, the angle θ of the bevel on the sides of the access recesses 129 may be greater than about 20 degrees, and more preferably may range from about 35 degree to about 55 degrees, and still more preferably may be about 50 degrees.

The upper base portion 126 is configured to support or carry a suction source 130 and a pump assembly 132 thereon. The suction source 130 is in fluid communication with the recovery tank 108 and is operable to draw recovered liquid and dirt from the surface being cleaned through a suction nozzle of the cleaning tool 120 and into the recovery tank 108 via the flexible hose 122. For example, the suction source 130 may include a motor and fan assembly 134 comprising a suction motor that rotates a fan or impeller to generate a suction airflow. In the illustrated embodiment, the suction source 130 is mounted on top of the upper base portion 126 proximate a rear end of the upper base portion 126 and the midpoint of the width of the upper base portion 126. The motor and fan assembly 134 may be arranged in an upright or vertical orientation such that the suction motor and the impeller thereof are aligned vertically and rotate about a common vertical axis. With this arrangement, a portion of the motor and fan assembly 134 is received in a seat 140 that is integrally formed in the top of the upper base portion 126. The seat 140 is generally shaped and sized to match the shape and size of the portion of the motor and fan assembly 134 being received therein. Also, a suction source housing 142 is secured to the upper base portion 126 over the motor and fan assembly 134. The suction source housing 142 is configured to cooperate with the upper base portion 126 to sandwich and securely hold the motor and fan assembly 134 therebetween.

The motor and fan assembly 134 is fluidly coupled to the recovery tank 108 via a working air conduit formed with a suction port 136. The suction port 136 is arranged proximate a front end of the upper base portion 126 and extends upwardly from the upper base portion 126 in generally a vertical orientation to a distal open end 138 to provide a fluid coupling with the recovery tank 108, as described further below. The suction port 136 may be integrally formed with the upper base portion 126 or may be separately formed from the upper base portion 126. The proximal end of the suction port 136 opposite the distal open 138 extends through the upper base portion 126 and is in fluid communication with the motor and fan assembly 134. For example, one or more passages may be formed by partitions or channels defined between the upper base portion 126 and the lower base portion 124 for delivering the working air drawn from the recovery tank 108 via the suction port 136 to the motor and fan assembly 134, where it can be discharged as exhaust. In some embodiments, a baffle 143 (FIG. 9) may be mounted on a shelf formed at the rear end of the upper base portion 126 to direct the exhaust air exiting the motor and fan assembly 134 downwardly through a plurality of slots formed in the shelf and/or rearwardly through vent portions 176 of the housing body 160, described further below.

The pump assembly 132 is in fluid communication with the supply tank 106 and the cleaning tool 120. The pump assembly 132 is operable to draw cleaning liquid from the supply tank 106 and to supply or deliver the cleaning liquid to the cleaning tool 120 where it can be dispensed onto a surface to be cleaned via a distribution nozzle of the cleaning tool 120. The pump assembly 132 may include a pump 144, for example, a DC pump or other suitable pump, and tubing or other conduits fluidly coupling the pump 144 to the supply tank 106 and the cleaning tool 120. In the illustrated embodiment, the pump 144 is mounted on top of the suction source housing 142 above the motor and fan assembly 134. In the illustrated embodiment, the pump 144 is arranged horizontally with its longitudinal pump axis transverse to the front-to-rear longitudinal axis 105 of the portable extractor 100. A pump cover 146 may be secured to the suction source housing 142 over the pump 144 to secure the pump 144 between pump cover 146 and the suction source housing 142. In other embodiments, the suction source 130 and the pump assembly 132 may be positioned elsewhere in the main housing 104.

The pump 144 of the pump assembly 132 is fluidly connected to the cleaning tool 120 via tubing 148 having one or more portions received or carried within or adjacent the flexible hose 122 to deliver cleaning liquid to the surface to be cleaned.

Figure 32:
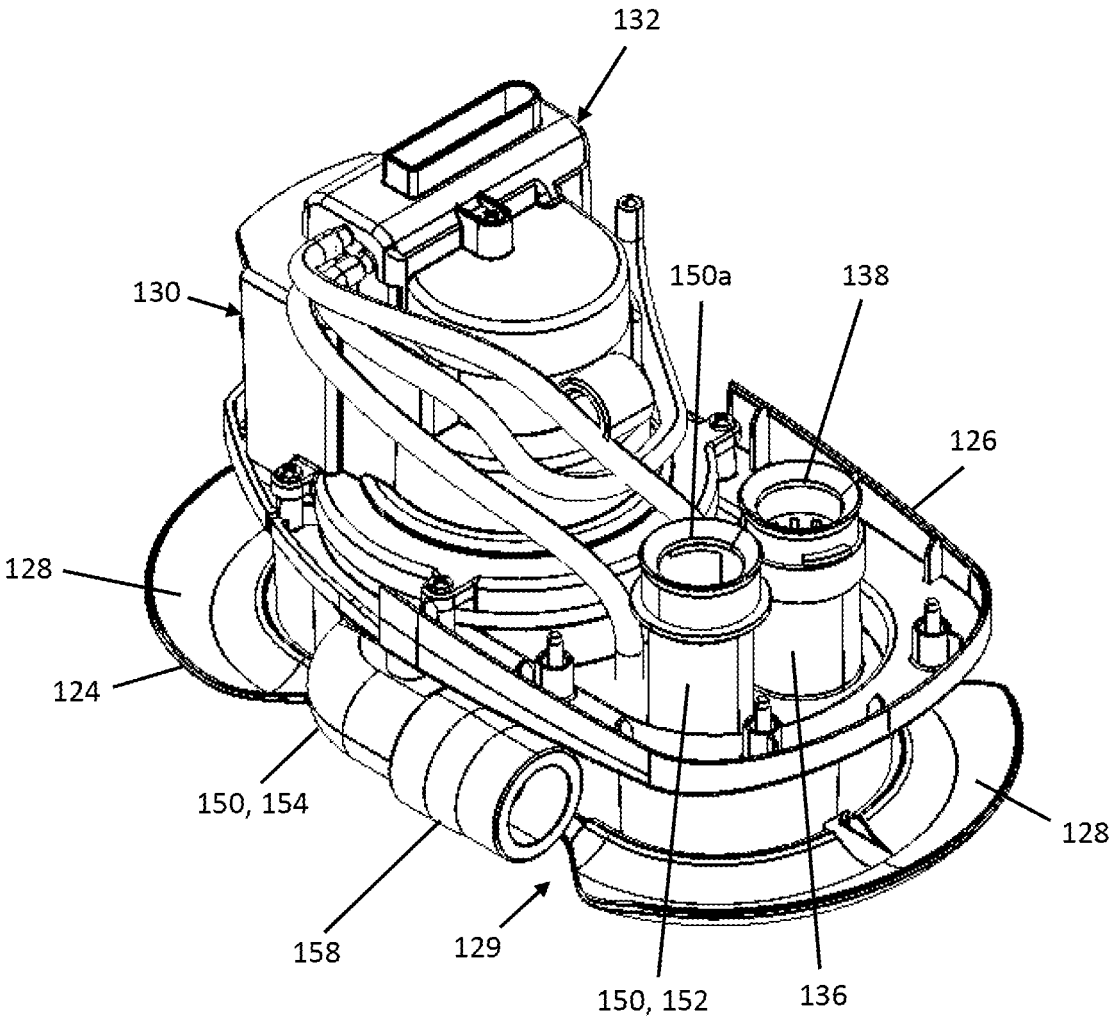
FIG. 32 is another perspective view of the portable extraction cleaner of FIG. 1.
Figure 33:
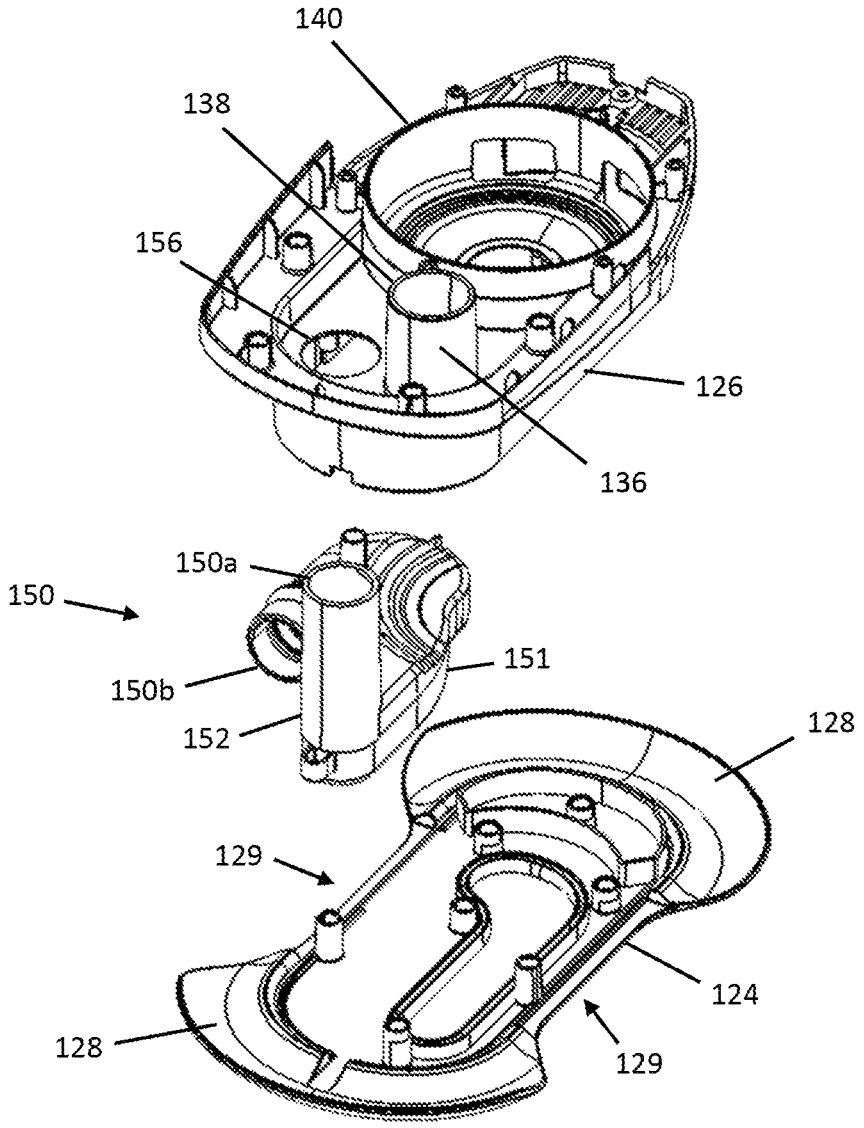
FIG. 33 is a partially exploded perspective view of the base of the portable extraction cleaner of FIG. 1.

In addition, referring to FIGS. 32-33 in particular, a hose connector 150 is provided to fluidly couple the flexible hose 122 to the recovery tank 108 so as to direct recovered liquid and dirt into the recovery tank 108. The hose connector 150 includes a suction conduit 151 connected between a tubular distal section 152 and an elbow-shaped proximal section 154. The suction conduit 151 is fixed between the upper base portion 126 and the lower base portion 124 and may be attached the lower base portion 124 and/or the upper base portion 126 using fasteners (e.g., screws, bolts, etc.), tabs or hooks. In one embodiment, the suction conduit 151 may be formed in part by the lower base portion 124. The tubular distal section 152 of the hose connector 150 extends upwardly from the upper base portion 126 through a hose connector opening 156 formed through the upper base portion 126 proximate the suction port 136. The tubular distal section 152 is oriented vertically and terminates at a distal open end 150*a* of the hose connector 150. The elbow-shaped proximal section 154 of the hose connector 150 exits and from a lateral side of the upper base portion 126 and extends to a proximal open end 150*b* of the hose connector 150 exterior to the upper base portion 126. The proximal open end 150*b* of the hose connector 150 defines a horizontal, longitudinal axis that extends generally along or parallel to the front-to-rear longitudinal axis 105 of the portable extractor 100. The hose connector 150 may be coupled at its proximal open end 150*b* to the flexible hose 122 via a tubular hose cuff 158. With this arrangement, the flexible hose 122 exits the hose cuff 158 in generally a horizontal direction tangentially to the side of the upper base portion 126 so as to facilitate wrapping the hose around the lower base portion 124 on the peripheral flanges 128 of the lower base portion 124 and minimize tension or kinking in the flexible hose 122.

With reference to FIGS. 23-32, the main housing 104 cooperates with the upper base portion 126 to cover, enclose or otherwise house the suction source 130 and the pump assembly 132 and may be attached to the upper base portion 126 in a mating relationship using fasteners (e.g., screws, bolts, etc.), tabs or hooks. The main housing 104 includes a housing body 160 configured to support each of the supply tank 106 and the recovery tank 108 in an upright or vertical orientation as described below.

Figure 34:
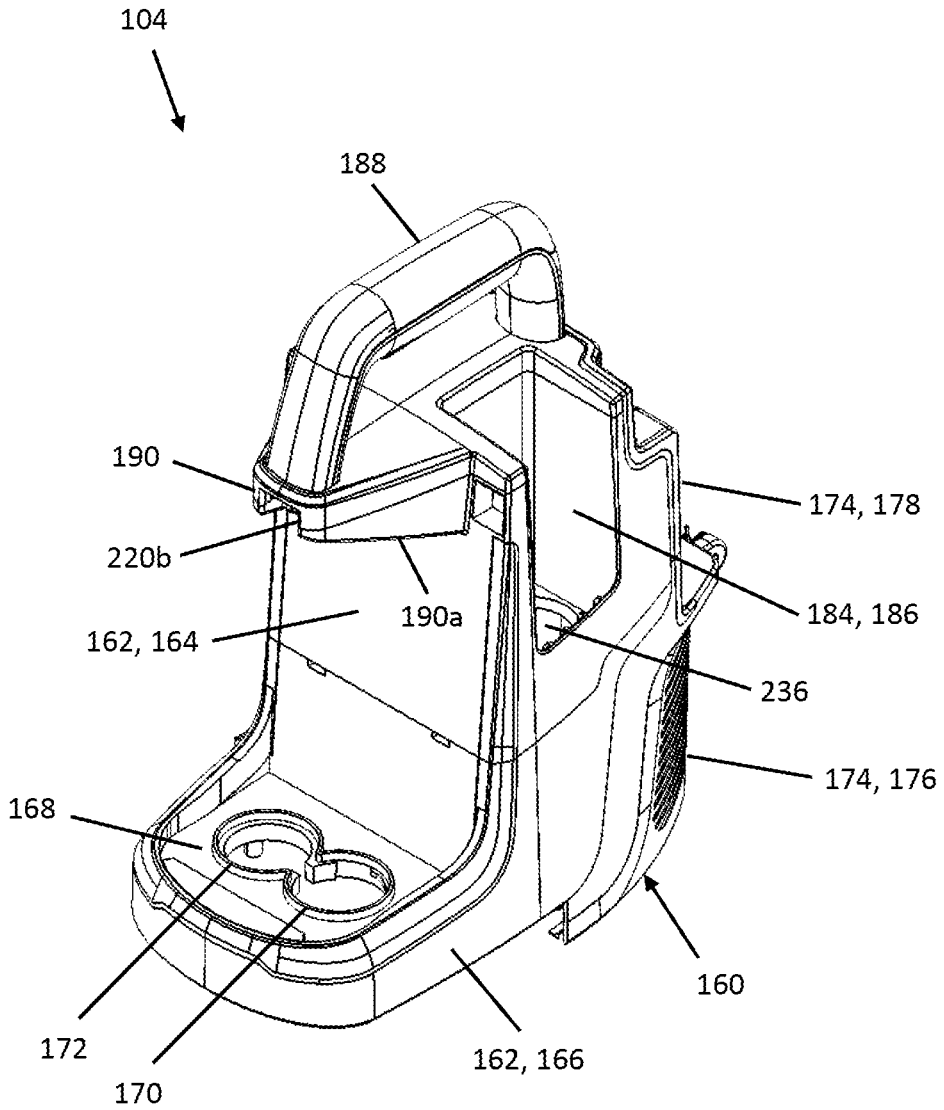
FIG. 34 is a perspective view of the main housing of the portable extraction cleaner of FIG. 1.
Figure 35:
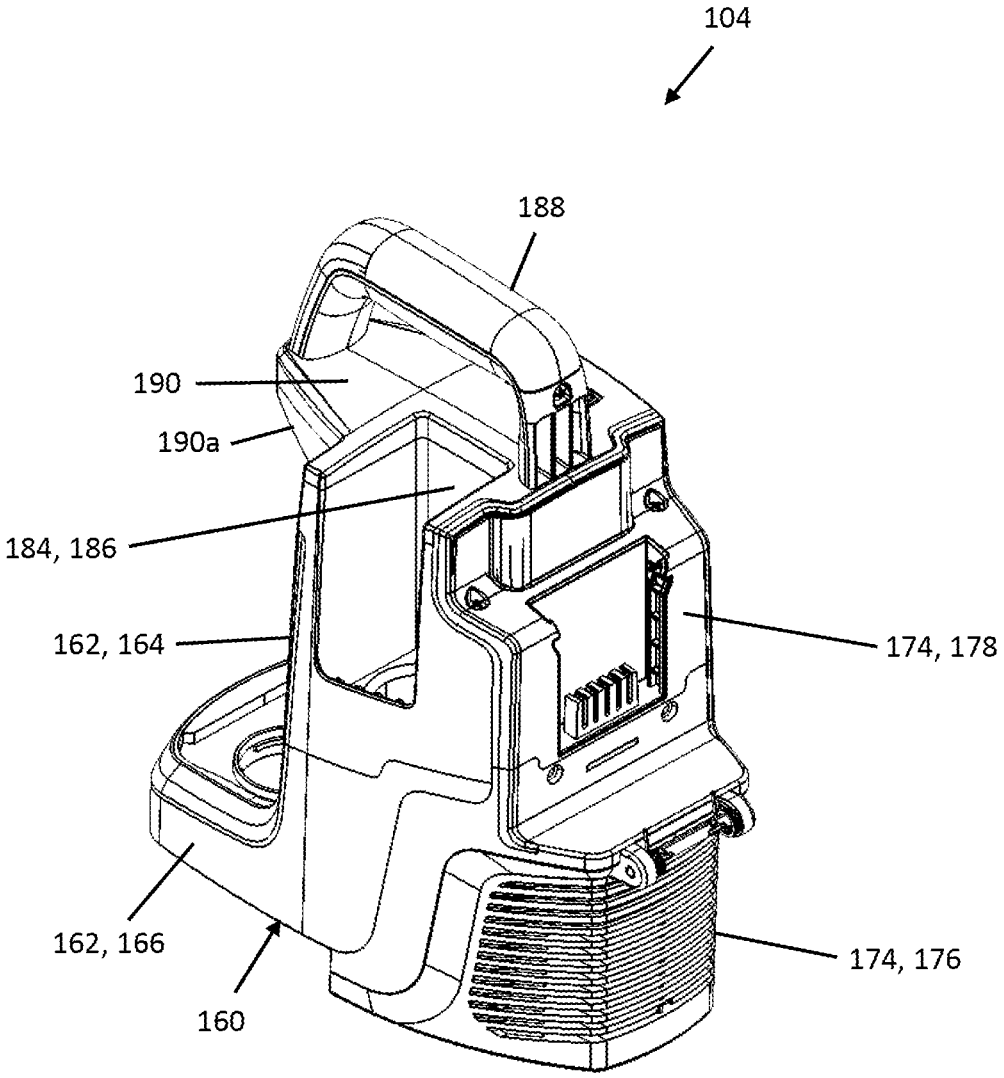
FIG. 35 is another perspective view of the main housing of the portable extraction cleaner of FIG. 1.

Referring to FIGS. 34-35, in the illustrated embodiment, the housing body 160 includes a front portion 162 having a reverse L-shaped profile. In particular, the front portion 162 includes a forwardly facing vertical face 164 and an upwardly facing horizontal platform 166 connected to the vertical face 164 at a lower end of the front portion 162. The platform 166 comprises a tank receptacle 168 that in one embodiment is generally shaped and sized to match the shape and size of the bottom end of the recovery tank 108 for removably receiving and supporting the recovery tank 108 thereon in a vertical orientation. When the recovery tank 108 is installed on the platform 166, portions of the recovery tank 108 at least partially define the front side 110 and the top side 118 of the portable extractor 100, as described further below. Two apertures 170, 172 are formed in the tank receptacle 168 and extend through the platform 166. The first aperture 170 receives the distal open end 138 of the suction port 136 for providing fluid communication between the recovery tank 108 and the suction source 130. The second aperture 172 receives the distal open end 150*a* of the hose connector 150 for providing fluid communication between the flexible hose 122 and the recovery tank 108.

The housing body 160 also includes a rear portion 174 arranged opposite the front portion 162. The rear portion 174 defines one or more vent portions 176 for venting the cooling air entering and exiting the suction source 130 and a battery compartment 178. In the illustrated embodiment, a plurality of slot-shaped vent portions 176 are formed symmetrically on opposite sides of the rear portion 174 proximate a lower end of the rear portion 174. Alternatively, the vent portions 176 may have any shape or location relative to the housing body 160 suitable for venting the cooling air entering and exiting the suction source 130.

The battery compartment 178 is configured to removably receive and to support the battery pack 180 at the rear side 112 of the portable extractor 100 opposite the front side 110. The battery pack 180 may include one or more battery cells for supplying power to operate the portable extractor 100, including the suction source 130 and the pump assembly 132. For example, the battery pack 180 may be a rechargeable battery pack 180 having one or more lithium-based cells. In the illustrated embodiment, the battery compartment 178 is formed at an upper end of the rear portion 174 of the housing body 160 and defines a longitudinal battery insertion axis extending in a vertical orientation. Thus, the battery pack 180 may be inserted into the battery compartment 178 along the vertical battery insertion axis. In particular, the battery compartment 178 is open at its top end to removably receive and to support a battery pack 180 in an upright or vertical orientation. The battery compartment 178 may include mating features shaped and configured to releasably engage complimentary features on the battery pack 180 when the battery pack 180 is inserted in the battery compartment 178. When the battery pack 180 is installed in the battery compartment 178, battery contacts on the battery pack 180 come into an electrically conductive connection with corresponding contacts in the battery compartment 178, which are electrically connected to the suction source 130 and the pump assembly 132.

Referring to FIGS. 25-27 and 29, the main housing 104 includes a battery cover 182 to selectively cover and uncover the battery pack 180. In the illustrated embodiment, the battery cover 182 is oriented upright in a closed position to cover the battery pack 180. The lower end of the battery cover 182 is pivotally coupled to the housing body 160 via a hinge joint that allows the battery cover 182 to rotate rearwardly and downwardly into an open position to uncover the battery pack 180. In the illustrated embodiment, when the battery cover 182 is in its upright, closed position, the upper end of the battery cover 182 is substantially flush with the top of housing body 160. The above arrangement for the battery compartment 178 and the battery pack 180 is compact and facilitates easy access and removal of the battery pack 180 using one hand to open the battery cover 182 and slide the battery pack 180 out of the battery compartment 178.

Referring back to FIGS. 34-35, the housing body 160 further includes an intermediate portion 186 coupled between the front portion 162 and the rear portion 174. A recessed supply tank cavity 184 is formed along an upper edge of the housing body 160 in the intermediate portion 186 and is open to a top surface and a side surface of the housing body 160. The recessed supply tank cavity 184 defines a longitudinal supply tank insertion axis extending in generally a vertical direction and its top end forms an insertion opening for inserting the supply tank 106. The supply tank 106 may be inserted into the recessed supply tank cavity 184 along the vertical supply tank insertion axis. With this arrangement, the recessed supply tank cavity 184 is configured to removably receive and support the supply tank 106 therein in an upright or vertical orientation. When the supply tank 106 is installed in the recessed supply tank cavity 184, the supply tank 106 is spaced rearwardly of the recovery tank 108 and portions of the supply tank 106 at least partially define the top side 118 and the first lateral side 114 of the portable extractor 100, as described further below.

A handle 188 is coupled on top of the housing body 160 for carrying the portable extractor 100. The illustrated handle 188 has an elongated shape and extends longitudinally of the housing body 160. More specifically, a horizontal, longitudinal axis of the handle 188 extends generally along or parallel to the front-to-rear longitudinal axis 105 of the portable extractor 100 between the recovery tank 108 and the battery pack 180. The handle 188 may be integrally formed with the housing body 160 as a single component or may be separately formed from the housing body 160. In the illustrated embodiment, a first end of the handle 188 is coupled to a top surface of the housing body 160. In the illustrated embodiment, the main housing 104 includes a support member 190, and a second end of the handle 188 opposite the first end is coupled to a top surface of the support member 190. Alternatively, the handle 188 extends transverse to the housing body 160. Specifically, the horizontal, longitudinal axis of the handle 188 may extend across the longitudinal axis 105 of the portable extractor 100.

In the illustrated embodiment, the support member 190 is connected to the vertical face 164 of the front portion 162 of the housing body 160 at an upper end of the front portion 162 and projects forwardly above the platform 166, and may be positioned above the recovery tank 108. The support member 190 may be arranged substantially flush with the top of housing body 160. In one alternative, a display or other user interface is provided on the support member 190 in view of an operator. One or more portions of the support member 190 may be integrally formed with the housing body 160 as a single component or may be separately formed from the rest of the housing body 160. In other embodiments, the handle 188 may have any shape or orientation relative to the housing body 160 and support member 190 and may be coupled to others parts of the housing body 160.

Figure 4:
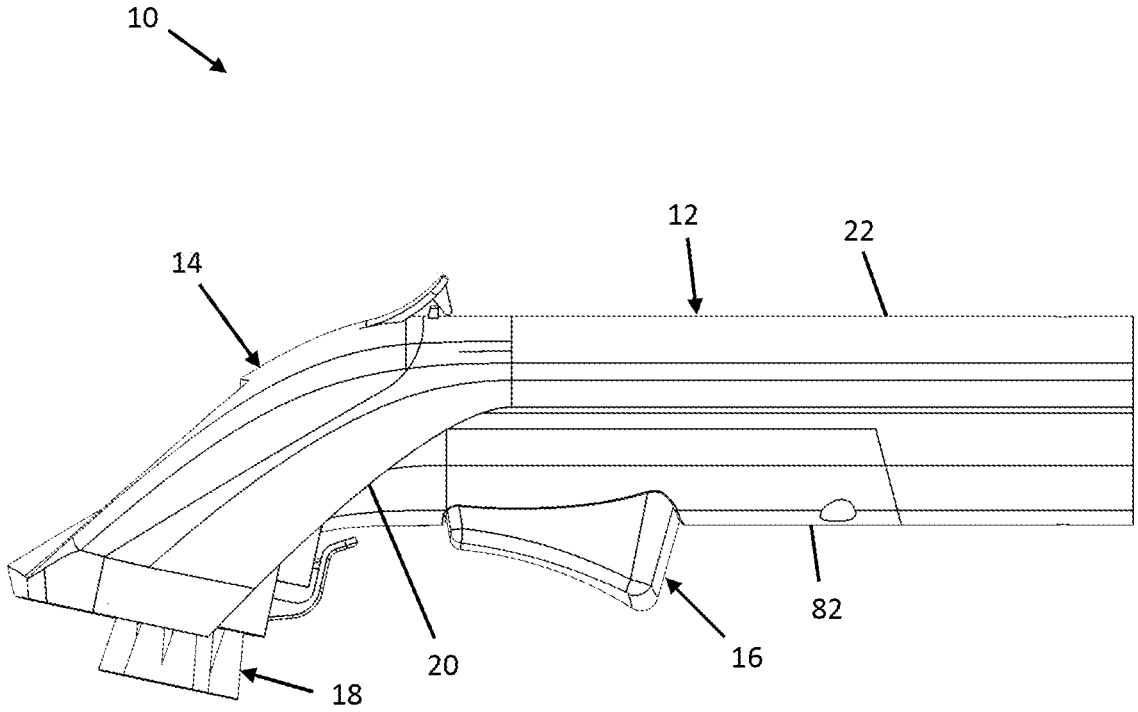
FIG. 4 is a left side elevational view of the cleaning tool of FIG. 1.
Figure 5:
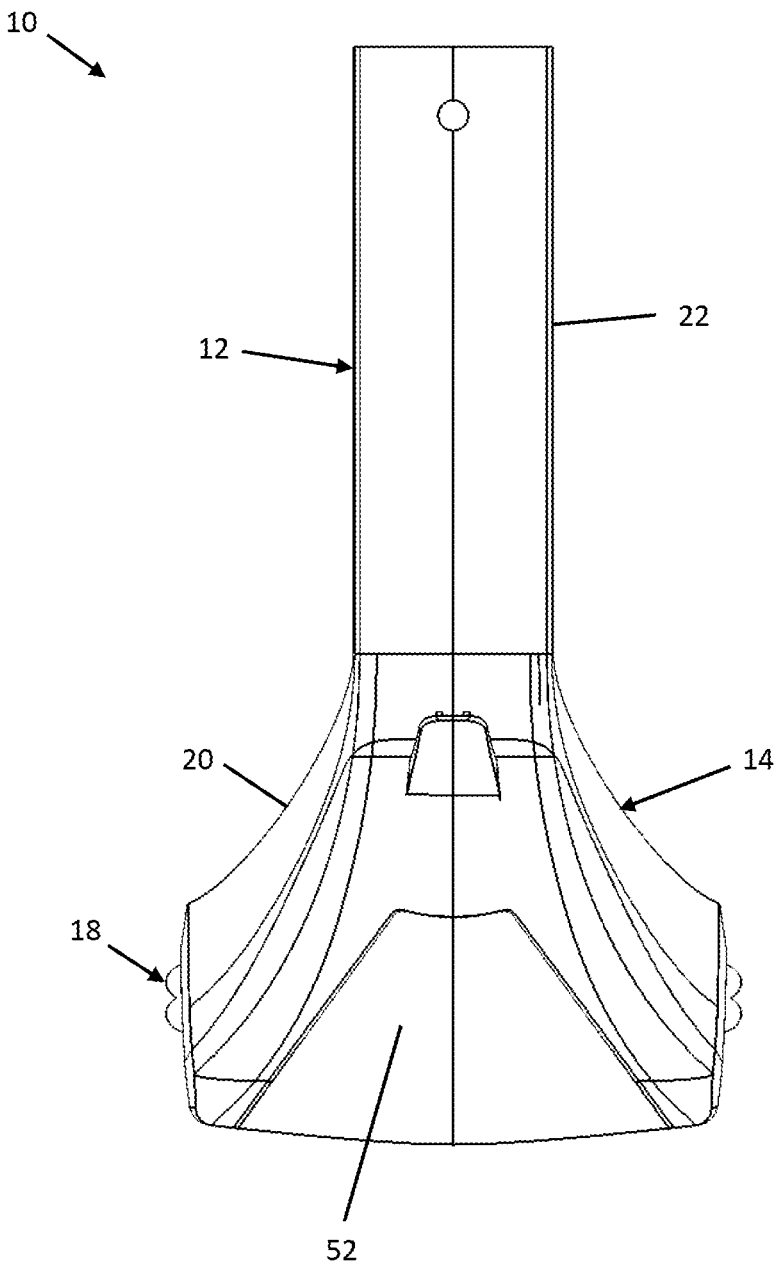
FIG. 5 is a top plan view of the cleaning tool of FIG. 1.
Figure 6:
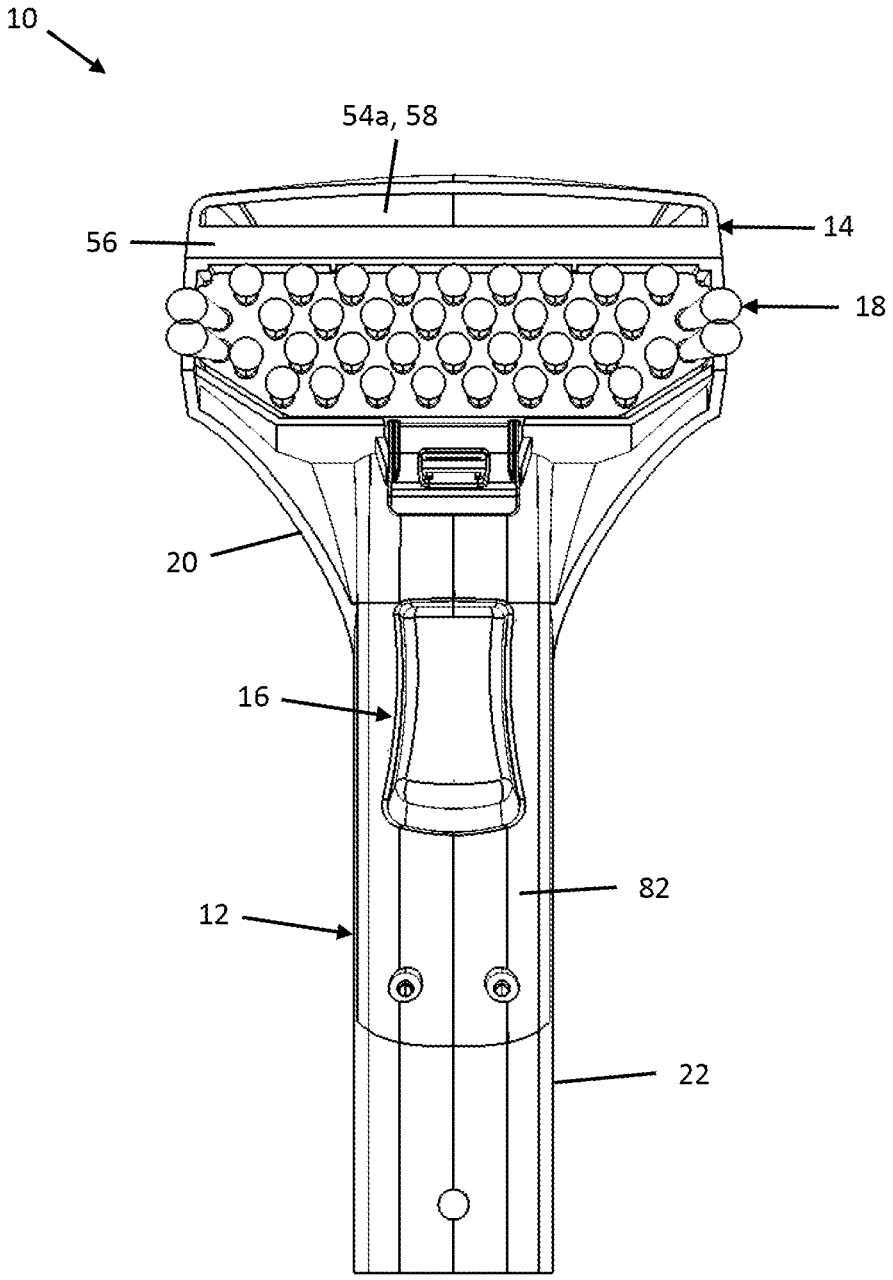
FIG. 6 is a bottom plan view of the cleaning tool of FIG. 1.
Figure 7:
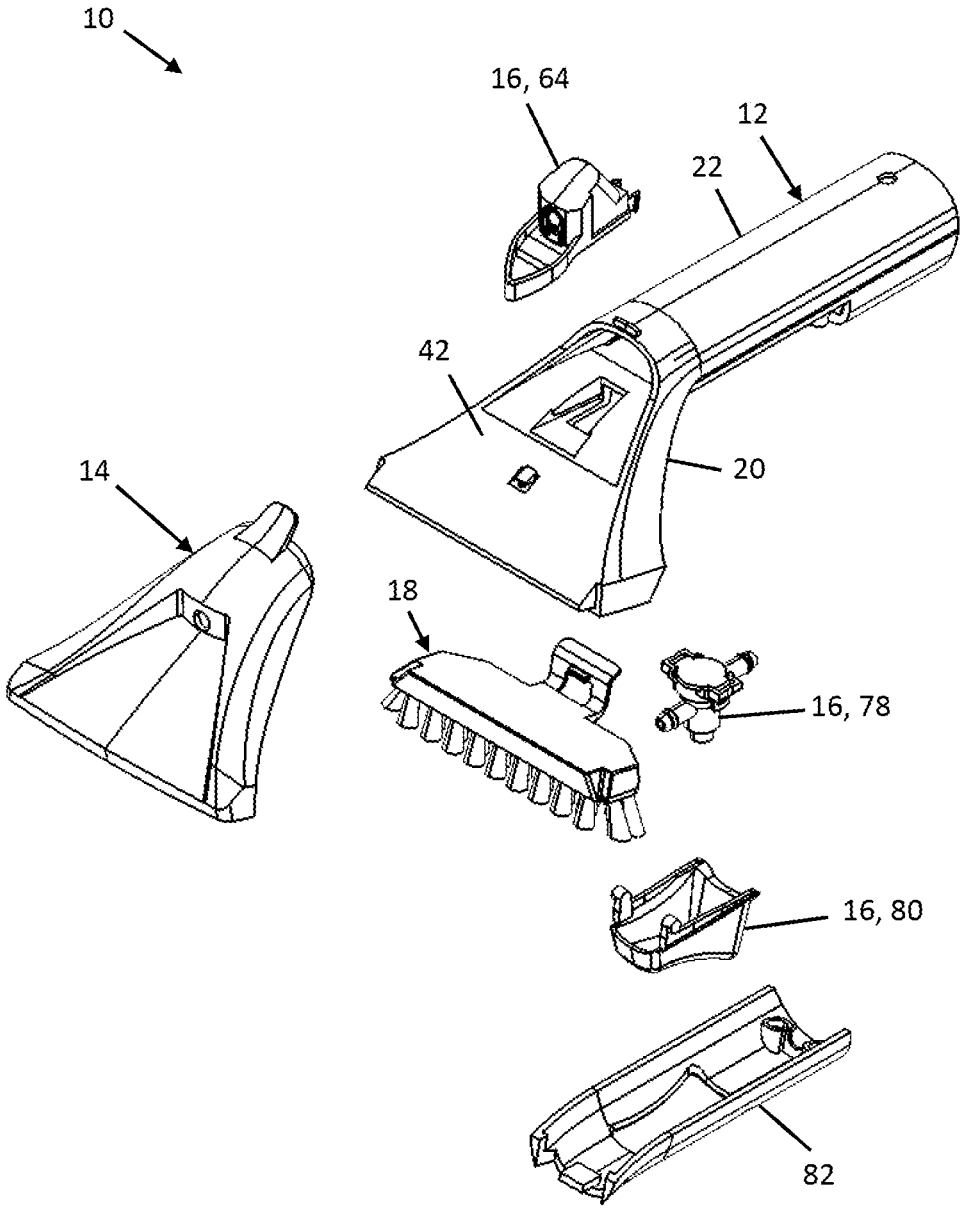
FIG. 7 is a partially exploded perspective view of the cleaning tool of FIG. 1 with the nozzle tube and the supply tube removed.
Figure 26:
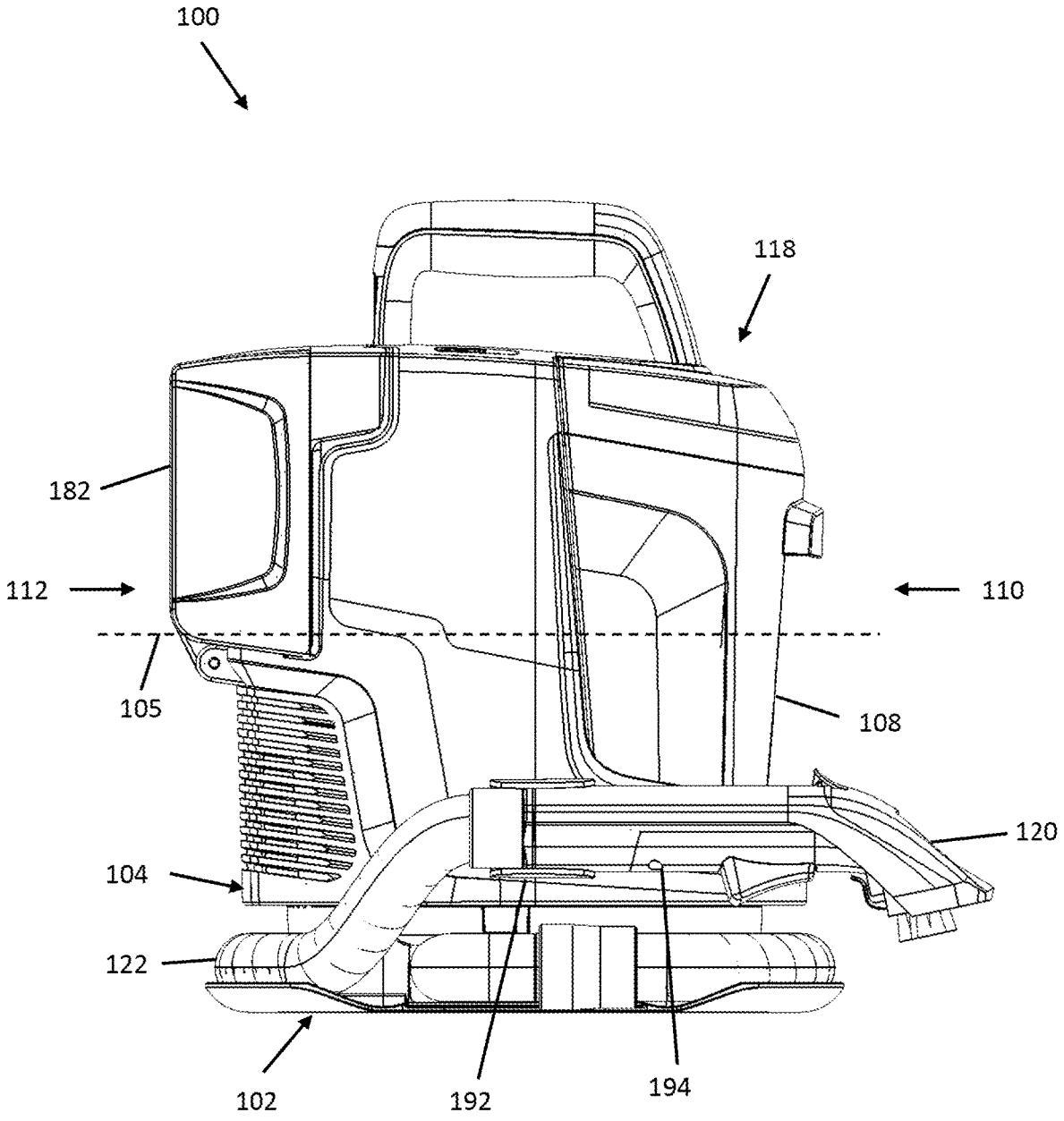
FIG. 26 is a left side elevational view of the portable extraction cleaner of FIG. 1.
Figure 27:
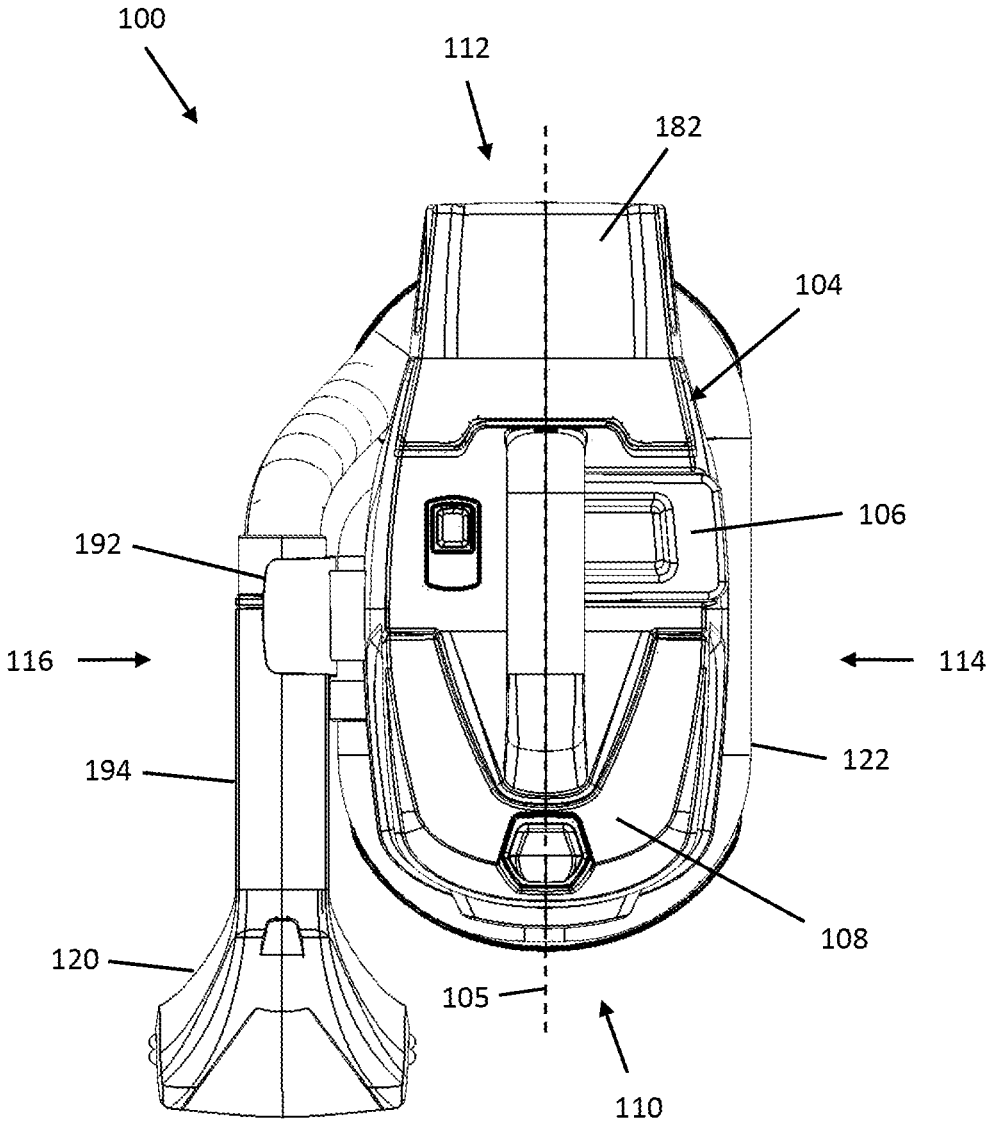
FIG. 27 is a top plan view of the portable extraction cleaner of FIG. 1.
Figure 28:
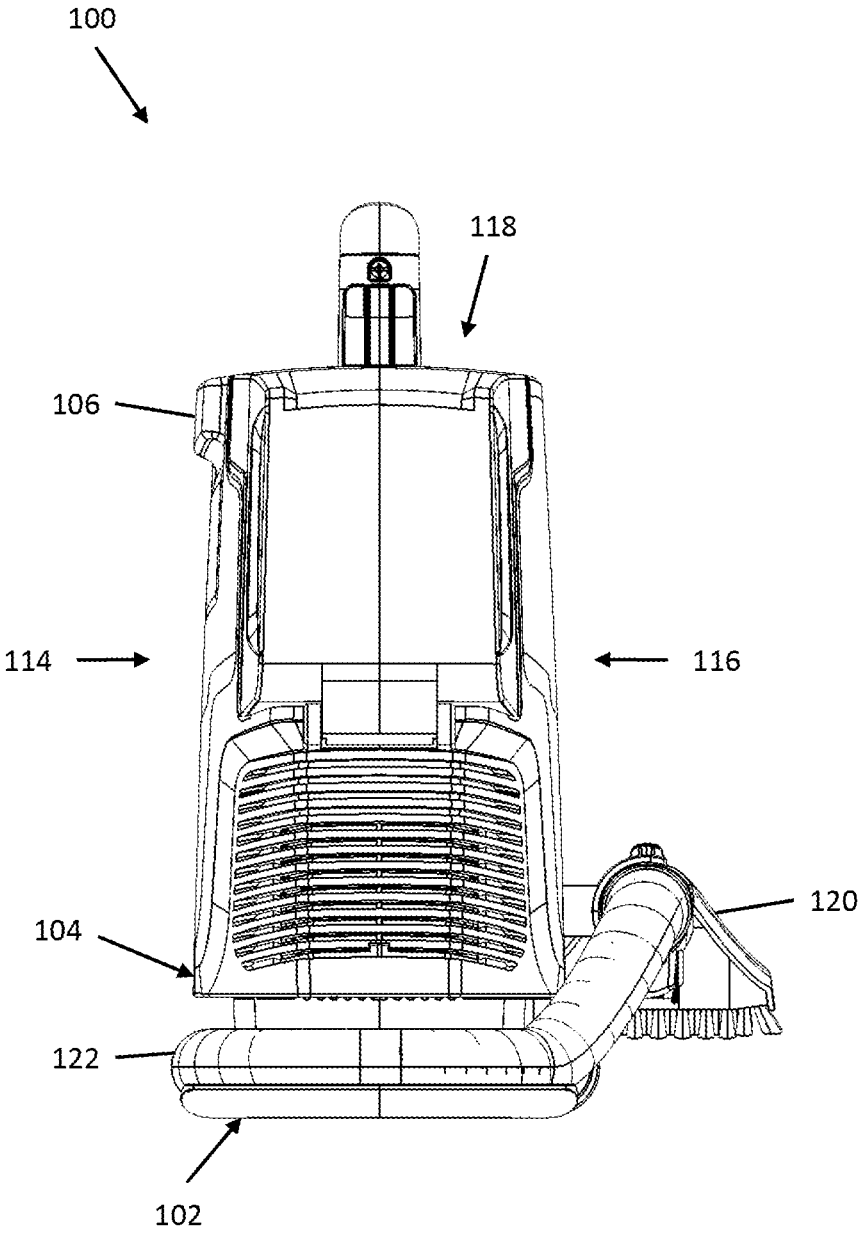
FIG. 28 is a rear side elevational view of the portable extraction cleaner of FIG. 1.
Figure 29:
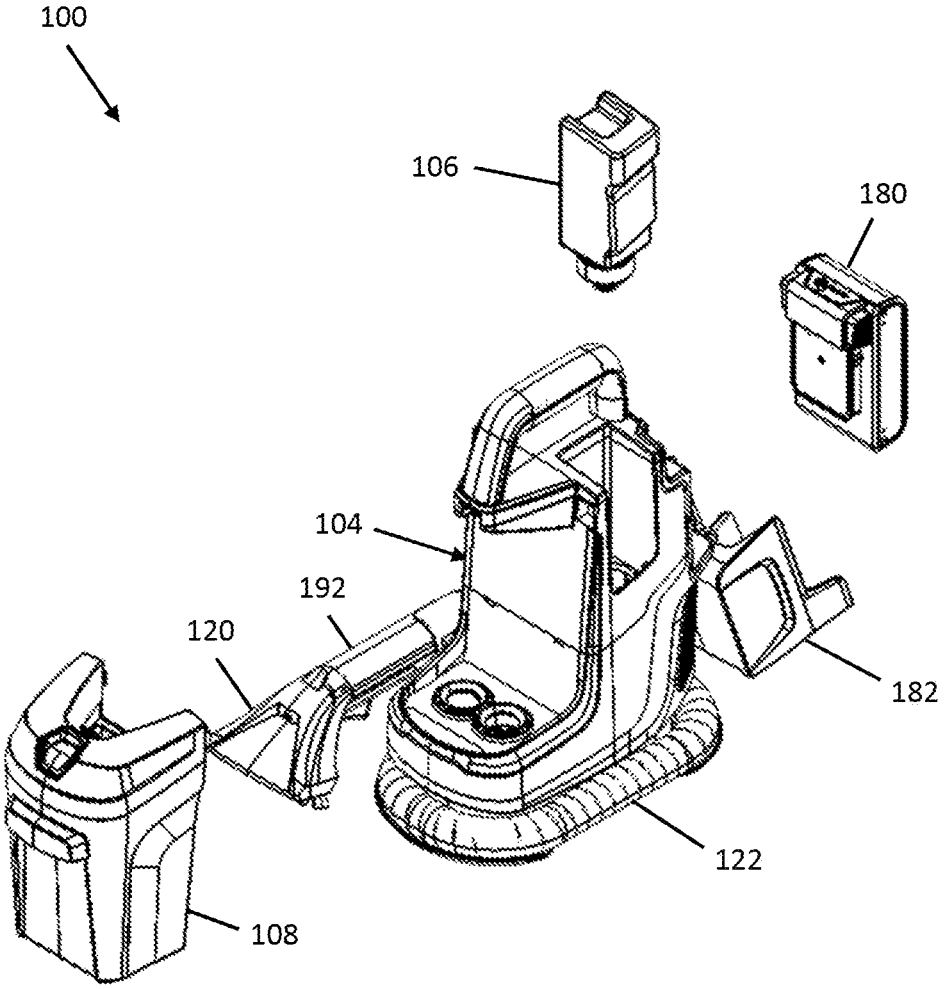
FIG. 29 is a partially exploded perspective view of the portable extraction cleaner of FIG. 1.
Figure 30:
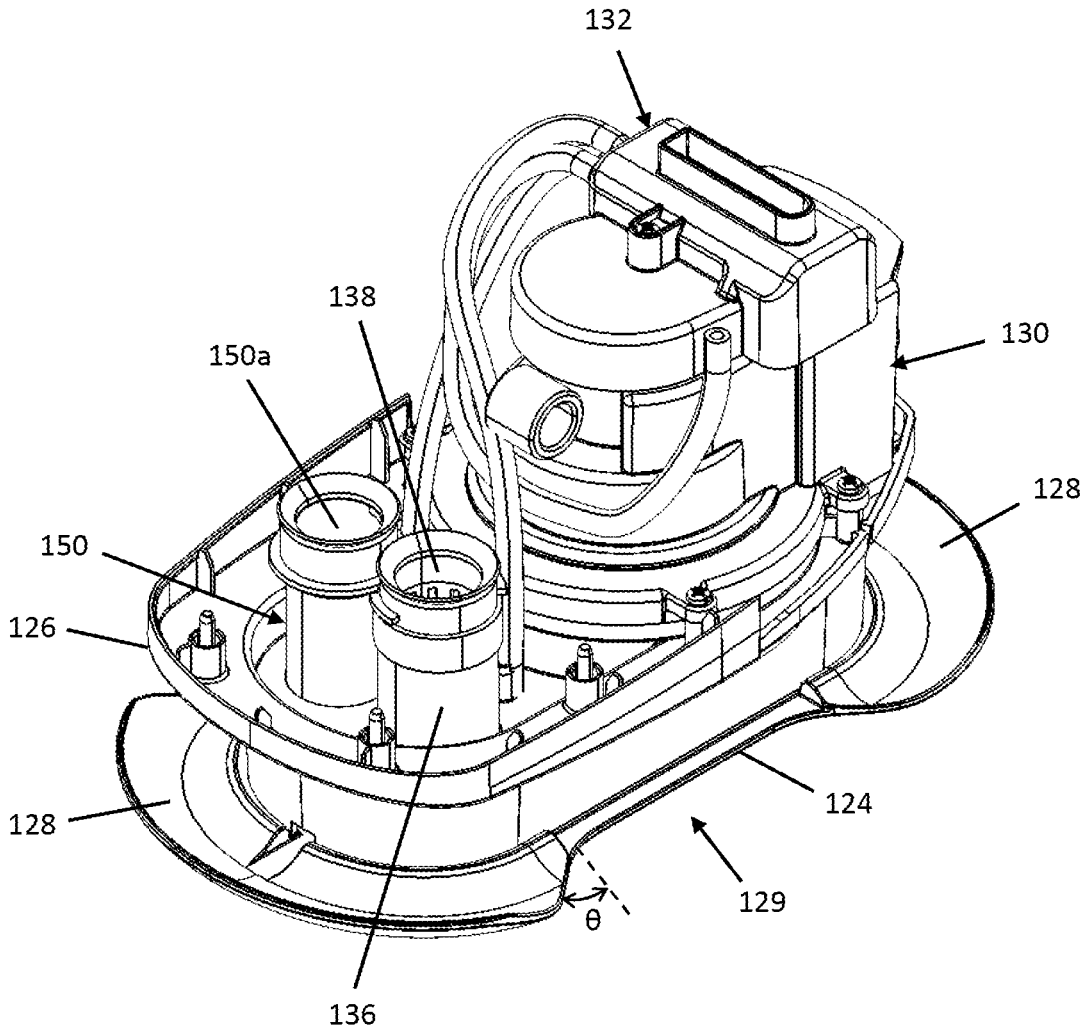
FIG. 30 is a perspective view of the base, suction source and pump assembly of the portable extraction cleaner of FIG. 1.
Figure 31:
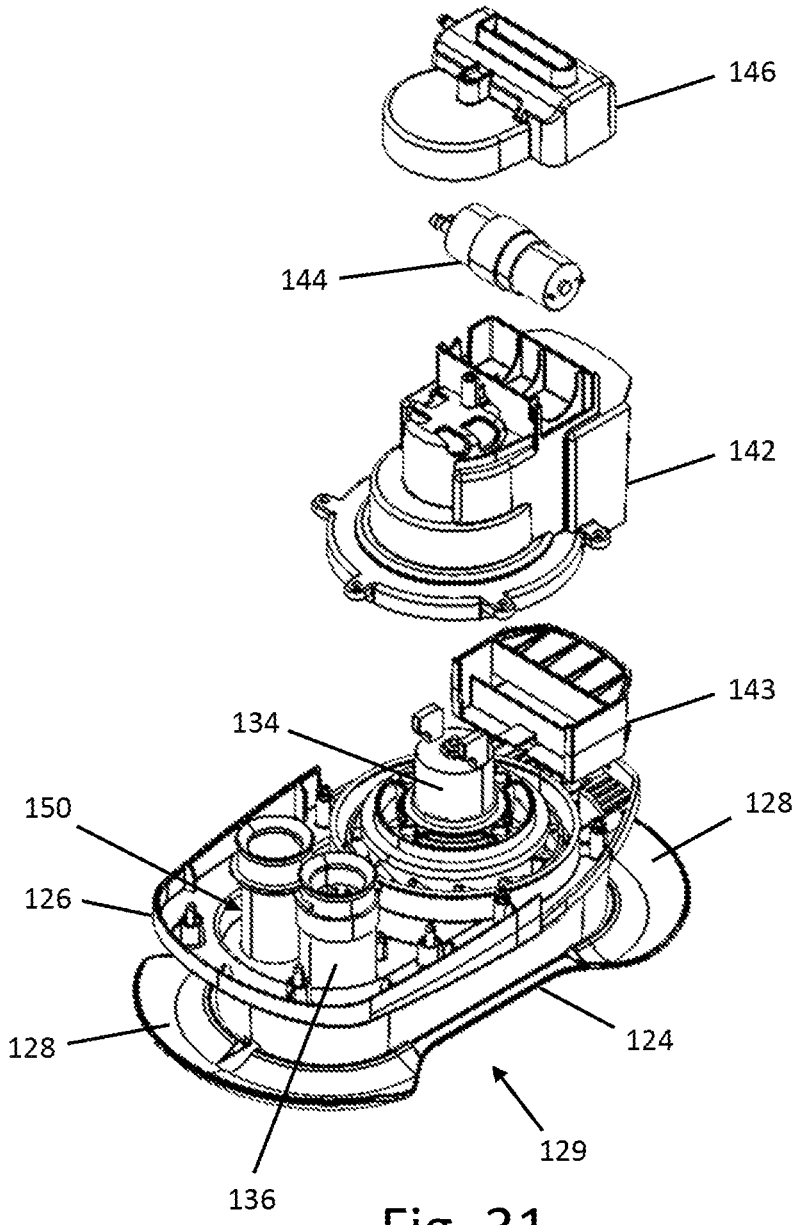
FIG. 31 is a partially exploded perspective view of the base, suction source and pump assembly of the portable extraction cleaner of FIG. 1.

In addition, as shown in FIGS. 26-27, a tool holder 192 configured to releasably hold an elongated handle 194 of the cleaning tool 120 is coupled to the housing body 160. The tool holder 192 may be fixed or may rotatable or otherwise adjustable so as to orient the cleaning tool 120 in different directions. In the illustrated embodiment, the tool holder 192 comprises at least one C-shaped support clip having an opening configured to releasably hold the elongated handle 194 of the cleaning tool 120. As shown in FIGS. 4 and 5, the opening of the C-shaped support clip may face a lateral side. Optionally, the opening of the C-shaped support clip may face in an upward direction. The tool holder 192 is coupled on a side of the housing body 160 proximate the bottom end of the housing body 160 such that the opening of the C-shaped clip defines a longitudinal axis oriented in generally a horizontal direction along or parallel to the front-to-rear longitudinal axis 105 of the portable extractor 100. As a result, the elongated handle 194 of the cleaning tool 120 is retained horizontally and tangentially to the side of the housing body 160 by the tool holder 192. This arrangement relieves tension on the end of the flexible hose 122 connected to the elongated handle 194 of the cleaning tool 120 when the hose is wrapped around the upper base portion 126 and provides a convenient compact configuration for storing the portable extractor 100. Alternatively, the tool holder 192 may comprise a magnetic assembly including a magnet coupled to one of the housing body 160 or the elongated handle 194 of the cleaning tool 120 and a ferromagnetic plate coupled to the other of the housing body 160 or the elongated handle 194 of the cleaning tool 120 such that the ferromagnetic plate is attracted to the magnet to releasably hold the cleaning tool 120 in place on the side of the housing body 160.

What is claimed is:

1. A cleaning tool for an extraction cleaner comprising:

a tool body including a nozzle portion connected to an elongated handle portion;

a nozzle cover removably mounted to the nozzle portion;

a suction nozzle configured to extract recovered liquid and dirt, the suction nozzle formed between the nozzle portion and the nozzle cover;

an internal conduit configured to transport recovered liquid and dirt extracted by the suction nozzle, the internal conduit extending longitudinally within the handle portion between opposite ends of the handle portion and having an inlet in fluid communication with the suction nozzle and an outlet configured to connect to an external hose;

a spray nozzle configured to distribute cleaning liquid forward of the nozzle cover, the spray nozzle mounted to the nozzle portion;

a valve mechanism configured to control a flow of cleaning liquid to the spray nozzle, the valve mechanism mounted to the handle portion peripherally of the internal conduit and in fluid communication with the spray nozzle; and a supply tube configured to carry cleaning liquid to the valve mechanism, the supply tube connected in fluid communication with the valve mechanism and extending at least partially within the internal conduit.

2. The cleaning tool of claim 1, wherein the spray nozzle passes through the suction nozzle or the inlet conduit.

3. The cleaning tool of claim 2, wherein the nozzle portion includes a frontal wall connected to a forward section of the handle portion adjacent a forward end of the internal conduit, the nozzle cover forming a fluid connection between the suction nozzle and the internal conduit, the nozzle cover having an aperture aligned with the spray nozzle configured for the spray nozzle to distribute cleaning liquid through the nozzle cover.

4. The cleaning tool of claim 1, wherein at least a portion of the spray nozzle is connected to and removable with the nozzle cover.

5. The cleaning tool of claim 1, wherein the spray nozzle includes a spray tip, and the spray tip is connected to and removable with the nozzle cover.

6. The cleaning tool of claim 1, wherein the handle portion includes a top wall along a length of the handle portion and a bottom wall connected to the top wall and including a forward section having a recess and a rear section, and the recess of the forward section transitions to the rear section at a step transition area of the bottom wall.

7. The cleaning tool of claim 6, wherein the supply tube extends through an opening formed in the step transition area.

8. The cleaning tool of claim 6 further comprising:

a tool body cover attached to the bottom wall over the forward section covering a first portion of the valve mechanism and receiving an actuator in an opening formed through the tool body cover configured to actuate the valve.

9. The cleaning tool of claim 1, wherein the supply tube is configured to connect to a delivery tube carried within the external hose and configured to deliver cleaning liquid from the extraction cleaner.

10. The cleaning tool of claim 1, wherein the supply tube extends through the external hose and configured to deliver cleaning liquid from the extraction cleaner.

11. The cleaning tool of claim 10 further comprising:

a cleaning head removably mounted to the nozzle portion, wherein the nozzle cover is removably mounted above a frontal wall of the nozzle portion and the cleaning head is removably mounted below the frontal wall of the nozzle portion, and the cleaning head includes a catch configured to engage resiliently with the nozzle portion.

12. The cleaning tool of claim 11, wherein the cleaning head is disposed in a plane that is at an acute angle with respect to a longitudinal axis of the handle portion.

13. The cleaning tool of claim 1 further comprising:

the handle portion having a detent formed by an aperture through a wall of the internal conduit, and the nozzle cover having a button on a resilient member configured to releasably engage the detent through the internal conduit inlet, wherein the button inhibits air ingress through the aperture into the internal conduit.

14. The cleaning tool of claim 13, wherein the button includes a seal engagable with the aperture.

15. The cleaning tool of claim 1 further comprising:

a cleaning head removably mounted to the nozzle portion, wherein the nozzle cover is removably mounted above a frontal wall of the nozzle portion and the cleaning head is removably mounted below the frontal wall of the nozzle portion, and the cleaning head includes a catch configured to engage resiliently with the nozzle portion.

16. The cleaning tool of claim 15, wherein the cleaning head is disposed in a plane that is at an acute angle with respect to a longitudinal axis of the handle portion.

17. A cleaning tool for an extraction cleaner comprising:

a tool body including a nozzle portion connected to an elongated handle portion;

a nozzle cover removably mounted to the nozzle portion forming a suction nozzle therebetween, the suction nozzle configured to extract recovered liquid and dirt;

an internal conduit in fluid communication with the suction nozzle configured to transport recovered liquid and dirt extracted by the suction nozzle, the internal conduit extending longitudinally within the handle portion between opposite ends of the handle portion, a spray nozzle configured to distribute cleaning liquid forward of the nozzle cover, and a supply tube configured to carry cleaning liquid to the spray nozzle, wherein the spray nozzle passes through the suction nozzle or the inlet conduit.

18. The cleaning tool of claim 17 further comprising:

a valve mechanism configured to control a flow of cleaning liquid to the spray nozzle, the valve mechanism mounted to the handle portion peripherally of the internal conduit between the supply tube and the spray nozzle.

19. The cleaning tool of claim 18, wherein the supply tube includes a first portion extending within the internal conduit and a second portion peripherally of the internal conduit, and the valve mechanism is between the second portion of the supply tube and the spray nozzle.

20. The cleaning tool of claim 19, wherein the internal conduit of the handle portion is connected to an external hose, and the first portion of the supply tube extends through the external hose configured to deliver cleaning liquid from the extraction cleaner.

21. The cleaning tool of claim 17, wherein the nozzle portion includes a frontal wall connected to the forward section of the handle portion adjacent a forward end of the internal conduit, the nozzle cover forming a fluid connection between the suction nozzle and the internal conduit, the nozzle cover having an aperture aligned with the spray nozzle configured for the spray nozzle to distribute cleaning liquid through the nozzle cover.

22. The cleaning tool of claim 21 wherein at least a portion of the spray nozzle is connected to and removable with the nozzle cover.

23. The cleaning tool of claim 17, wherein the valve mechanism is actuatable by a trigger.

* * * * *